US009926870B2

(12) United States Patent
Hashizume et al.

(10) Patent No.: US 9,926,870 B2
(45) Date of Patent: Mar. 27, 2018

(54) WARM-UP CONTROL APPARATUS FOR GENERAL-PURPOSE ENGINE

(75) Inventors: Takashi Hashizume, Wako (JP); Tomoki Fukushima, Wako (JP); Shigeru Saito, Wako (JP)

(73) Assignee: HONDA MOTOR CO, LTD., Tokyo (JP)

( * ) Notice: Subject to any disclaimer, the term of this patent is extended or adjusted under 35 U.S.C. 154(b) by 1064 days.

(21) Appl. No.: 13/219,162

(22) Filed: Aug. 26, 2011

(65) Prior Publication Data

US 2012/0059570 A1 Mar. 8, 2012

(30) Foreign Application Priority Data

Sep. 8, 2010 (JP) ..... 2010-201471
Sep. 8, 2010 (JP) ..... 2010-201473
Sep. 8, 2010 (JP) ..... 2010-201474

(51) Int. Cl.
*F02D 41/06* (2006.01)
*F02D 28/00* (2006.01)
*F02D 41/30* (2006.01)

(52) U.S. Cl.
CPC ..... *F02D 41/068* (2013.01); *F02D 2200/021* (2013.01); *F02D 2200/0404* (2013.01); *F02D 2200/10* (2013.01)

(58) Field of Classification Search
CPC .. F02D 41/06; F02D 41/064; F02D 2200/021; F02D 2200/0404;
(Continued)

(56) References Cited

U.S. PATENT DOCUMENTS 3,964,443 A * 6/1976 Hartford ..... 123/406.55
3,969,614 A * 7/1976 Moyer et al. ..... 701/103
(Continued)

FOREIGN PATENT DOCUMENTS

DE 3538520 A1 * 5/1987
JP 58178833 A * 10/1983
(Continued)

OTHER PUBLICATIONS

Japanese Office Action; Application No. 2010-201471 dated Jun. 12, 2013.
(Continued)

*Primary Examiner* — Mahmoud Gimie
*Assistant Examiner* — John Zaleskas
(74) *Attorney, Agent, or Firm* — Westerman, Hattori, Daniels & Adrian, LLP

(57) ABSTRACT

In an apparatus for controlling warm-up operation of a general-purpose internal combustion engine having a throttle valve installed in an air intake pipe and connectable to an operating machine to be used as a prime mover of the machine, it is configured to calculate a basic fuel injection amount based on an engine speed and a throttle opening and control engine warm-up operation by calculating a warm-up time fuel injection amount by correcting the calculated basic fuel injection amount based on one of a temperature change amount of a spark plug seat of the engine, the throttle opening and an output of the operating machine and injecting fuel from an injector by the calculated warm-up time fuel injection amount. With this, it becomes possible to calculate a fuel injection amount suitable for the engine warm-up condition by using an appropriate parameter in place of the lubricating oil temperature.

28 Claims, 21 Drawing Sheets

(58) Field of Classification Search
CPC ..... F02D 2200/10; F02D 2200/1002; F02D 2200/1004; F02D 2200/1006; F02D 2200/101; F02D 2400/04; F02D 2400/06
USPC ..... 123/179.16, 179.17, 179.3, 349, 350, 123/360–362, 478, 480, 486, 491, 494, 123/434, 435, 680, 681, 683, 685, 686, 123/689; 701/102–104, 113
See application file for complete search history.

(56) References Cited

U.S. PATENT DOCUMENTS

| | | | | | |
|---|---|---|---|---|---|
| 4,089,317 | A | * | 5/1978 | Drews et al. | 123/179.17 |
| 4,143,621 | A | * | 3/1979 | Long | 123/491 |
| 4,227,491 | A | * | 10/1980 | Schnurle et al. | 123/488 |
| 4,313,412 | A | * | 2/1982 | Hosaka et al. | 123/480 |
| 4,432,325 | A | * | 2/1984 | Auracher et al. | 123/406.47 |
| 4,469,072 | A | * | 9/1984 | Kobayashi et al. | 123/491 |
| 4,478,194 | A | * | 10/1984 | Yamato et al. | 123/491 |
| 4,508,084 | A | * | 4/1985 | Yamato et al. | 123/492 |
| 4,515,130 | A | * | 5/1985 | Hasegawa | 123/493 |
| 4,535,736 | A | * | 8/1985 | Taura et al. | 123/344 |
| 4,582,036 | A | * | 4/1986 | Kiuchi et al. | 123/491 |
| 4,653,452 | A | * | 3/1987 | Sawada et al. | 123/491 |
| 4,711,217 | A | * | 12/1987 | Kano et al. | 123/491 |
| 4,712,522 | A | * | 12/1987 | Anzai et al. | 123/179.15 |
| 4,719,885 | A | * | 1/1988 | Nagano et al. | 123/179.17 |
| 4,765,300 | A | * | 8/1988 | Fujimura et al. | 123/491 |
| 4,765,301 | A | * | 8/1988 | Koike et al. | 123/491 |
| 4,770,135 | A | * | 9/1988 | Jautelat et al. | 123/179.17 |
| 4,773,378 | A | * | 9/1988 | Fujimura et al. | 123/491 |
| 4,938,197 | A | * | 7/1990 | Kido et al. | 123/492 |
| 4,987,871 | A | * | 1/1991 | Nishikawa | 123/362 |
| 5,024,191 | A | * | 6/1991 | Nagahiro et al. | 123/198 D |
| 5,050,559 | A | * | 9/1991 | Kurosu et al. | 123/478 |
| 5,394,857 | A | * | 3/1995 | Yamakawa | 123/686 |
| 5,441,030 | A | * | 8/1995 | Satsukawa | 123/491 |
| 5,586,539 | A | * | 12/1996 | Yonekawa et al. | 123/458 |
| 5,595,159 | A | * | 1/1997 | Huber et al. | 123/362 |
| 5,669,714 | A | * | 9/1997 | Runne | 374/208 |
| 5,701,871 | A | * | 12/1997 | Munakata et al. | 123/491 |
| 6,062,202 | A | * | 5/2000 | Chasteen | F02D 37/02 123/478 |
| 6,216,651 | B1 | * | 4/2001 | Ishikawa et al. | 123/73 AD |
| 6,220,225 | B1 | * | 4/2001 | Mencher et al. | 123/491 |
| 6,247,455 | B1 | * | 6/2001 | Otake | F02B 75/243 123/435 |
| 6,363,916 | B2 | * | 4/2002 | Kawakami et al. | 123/491 |
| 6,474,307 | B1 | * | 11/2002 | Ohuchi | F02D 41/062 123/179.16 |
| 6,481,405 | B2 | * | 11/2002 | Fujino et al. | 123/179.3 |
| 6,619,270 | B2 | * | 9/2003 | Yomogida | 123/491 |
| 6,729,305 | B2 | * | 5/2004 | Hoshi | 123/491 |
| 6,901,919 | B2 | * | 6/2005 | Namari et al. | 123/588 |
| 7,418,946 | B2 | * | 9/2008 | I et al. | 123/406.45 |
| 2001/0032621 | A1 | * | 10/2001 | Kojima et al. | 123/492 |
| 2004/0020478 | A1 | * | 2/2004 | Namari et al. | 123/588 |
| 2004/0078352 | A1 | * | 4/2004 | Fujime | 706/26 |
| 2005/0066943 | A1 | * | 3/2005 | Tanaka et al. | 123/491 |
| 2010/0145595 | A1 | * | 6/2010 | Bellistri et al. | 701/103 |
| 2011/0005024 | A1 | * | 1/2011 | Spitler et al. | 15/320 |
| 2012/0059569 | A1 | * | 3/2012 | Saito et al. | 701/104 |

FOREIGN PATENT DOCUMENTS

| | | | | |
|---|---|---|---|---|
| JP | 58200053 | A | * | 11/1983 |
| JP | 60035138 | A | * | 2/1985 |
| JP | 63-001729 | A | | 1/1988 |
| JP | 63-08637 | A | | 8/1988 |
| JP | 06221193 | A | * | 8/1994 |
| JP | 2000154744 | A | * | 6/2000 |
| JP | 2001-115871 | A | | 4/2001 |
| JP | 2004-060555 | A | | 2/2004 |
| JP | 2004-285834 | A | | 10/2004 |
| JP | 2006083869 | A | * | 3/2006 |
| JP | 2009-191628 | A | | 8/2009 |
| JP | 2009191628 | A | * | 8/2009 |

OTHER PUBLICATIONS

Japanese Office Action, Japanese Patent Application No. 2010-201474, dated Jul. 24, 2013.

* cited by examiner

FIG.4

| ENGINE TEMPERATURE T [°C] | −25 | 0 | 25 | 50 | 100 |
|---|---|---|---|---|---|
| START FUEL INJECTION AMOUNT [$mm^3$] | 100 | 50 | 30 | 10 | 3 |

FIG.5

| ENGINE TEMPERATURE T [°C] | −25 | 0 | 25 | 50 | 100 |
|---|---|---|---|---|---|
| WARM-UP CORRECTION COEFFICIENT INITIAL VALUE [FACTOR] | 1.4 | 1.3 | 1.2 | 1.1 | 1.0 |
| WARM-UP CORRECTION COEFFICIENT DECREASING AMOUNT [FACTOR] | 0.001 | 0.002 | 0.003 | 0.005 | 0 |

WARM-UP CONTROL APPARATUS FOR GENERAL-PURPOSE ENGINE

BACKGROUND

Technical Field

This embodiment relates to a warm-up control apparatus for a general-purpose internal combustion engine.

Background Art

Conventionally, there is proposed a technique for an engine warm-up operation control apparatus to increase a fuel injection amount with a warm-up correction coefficient calculated based on a temperature of lubricating oil during the warm-up operation, as taught, for example, in Japanese Laid-Open Patent Application No. 2004-285834 (paragraphs 0042 to 0046, FIG. 6, etc.).

SUMMARY

However, when it is configured as above to increase the fuel injection amount based on the lubricating oil temperature, since it takes some time until the increase in engine temperature through the warm-up operation is transferred to the lubricating oil, the warm-up condition of the engine will not be immediately reflected and hence, it hinders accurate calculation of the fuel injection amount suitable for the warm-up condition. As a result, the warm-up operation may continue for a more time period than necessary and it results in the increase of fuel consumption, disadvantageously.

An object of the embodiments is therefore to overcome the foregoing problem by providing a warm-up control apparatus for a general-purpose engine that can calculate a fuel injection amount suitable for the engine warm-up condition by using an appropriate parameter in place of the lubricating oil temperature.

In order to achieve the object, the embodiment provides in its first aspect an apparatus for controlling warm-up operation of a general-purpose internal combustion engine having a throttle valve installed in an air intake pipe and connectable to an operating machine to be used as a prime mover of the machine, comprising: a basic fuel injection amount calculator adapted to calculate a basic fuel injection amount based on a speed of the engine and a throttle opening of the throttle valve; and a warm-up controller adapted to control warm-up operation of the engine to calculate a warm-up time fuel injection amount by correcting the calculated basic fuel injection amount based on one of a temperature change amount of a spark plug seat of the engine, the throttle opening and an output of the operating machine and injecting fuel from an injector by the calculated warm-up time fuel injection amount.

In order to achieve the object, the embodiment provides in its second aspect a method for controlling warm-up operation of a general-purpose internal combustion engine having a throttle valve installed in an air intake pipe and connectable to an operating machine to be used as a prime mover of the machine, comprising the steps of: calculating a basic fuel injection amount based on a speed of the engine and a throttle opening of the throttle valve; and controlling warm-up operation of the engine by calculating a warm-up time fuel injection amount by correcting the calculated basic fuel injection amount based on one of a temperature change amount of a spark plug seat of the engine, the throttle opening and an output of the operating machine and injecting fuel from an injector by the calculated warm-up time fuel injection amount.

BRIEF DESCRIPTION OF DRAWINGS

The above and other objects and advantages will be more apparent from the following description and drawings in which:

FIG. 4 is an explanatory view showing a map (mapped data) to be used in the processing of the FIG. 3 flowchart;

FIG. 5 is an explanatory view showing a map (mapped data) to be used in the processing of the FIG. 3 flowchart;

DESCRIPTION OF EMBODIMENTS

A warm-up control apparatus for a general-purpose engine according to embodiments will now be explained with reference to the attached drawings.

Figure 1:
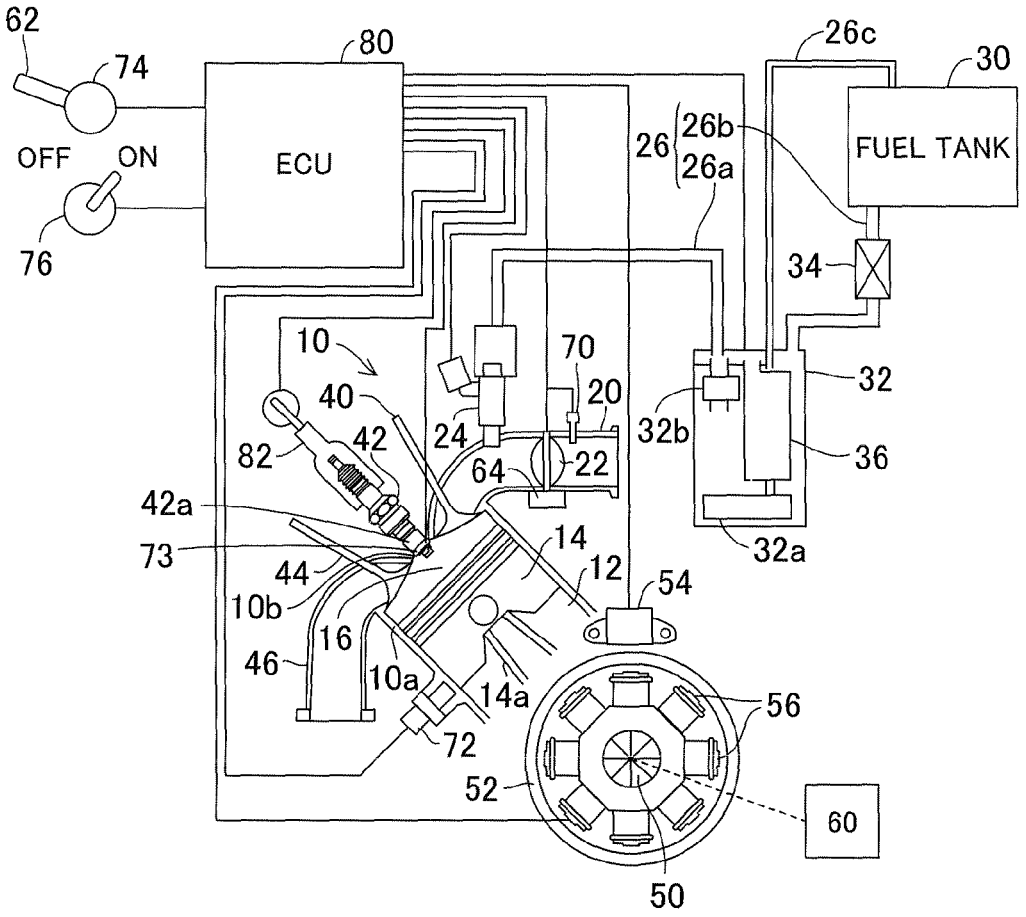
FIG. 1 is an overall view schematically showing a warm-up control apparatus for a general-purpose engine according to a first embodiment.

In FIG. 1, reference numeral 10 designates a general-purpose engine (general-purpose internal combustion engine). The engine 10 is a gasoline-injection, single-cylinder, air-cooled, four-cycle, OHV engine with a displacement of, for example, 400 cc. The engine 10 comprises a general-purpose internal combustion engine usable as a prime mover of (connectable to) an industrial small operating machine for agricultural, constructional and other use.

A cylinder 12 formed in a cylinder block 10*a* of the engine 10 accommodates a piston 14 that reciprocates therein. A cylinder head 10*b* is attached to the cylinder block 10*a* and a combustion chamber 16 is formed between the cylinder head 10*b* and the crown of the piston 14.

The combustion chamber 16 is connected to an air intake pipe 20. The air intake pipe 20 is installed with a throttle valve 22 and at the downstream thereof, further installed with an injector 24 near an intake port. The injector 24 is connected to a fuel tank 30 through a fuel supply pipe 26.

To be more specific, the injector 24 is connected to a sub fuel tank 32 through a first fuel supply pipe 26*a* and the sub fuel tank 32 is connected to the fuel tank 30 through a second fuel supply pipe 26*b*.

The second fuel supply pipe 26*b* is interposed with a low-pressure pump 34 to pump fuel (gasoline) stored in the fuel tank 30 to be forwarded to the sub fuel tank 32. The sub fuel tank 32 is installed with a fuel pump (high-pressure pump) 36.

The fuel pump 36 pressurizes the fuel forwarded and filtered through a filter 32*a* and, as the fuel's pressure is regulated by a regulator 32*b*, pumps the fuel to be forwarded to the injector 24 through the fuel supply pipe 26*a*. A part of the fuel in the sub fuel tank 32 is returned to the fuel tank 30 through a return pipe 26*c*.

The intake air sucked through an air cleaner (not shown) is flown through the air intake pipe 20. After the flow rate is regulated by the throttle valve 22, the intake air reaches the intake port and is mixed with the fuel injected from the injector 24 to form the air-fuel mixture.

When an intake valve 40 is opened, the air-fuel mixture is flown into the combustion chamber 16 and ignited by a spark plug 42 installed near the combustion chamber 16 to burn, thereby driving the piston 14. When an exhaust valve 44 is opened, the exhaust gas produced through the combustion is flown through an exhaust pipe 46 and discharged to the exterior.

A crankcase (not shown) is attached to the cylinder block 10*a* on the side opposite from the cylinder head 10*b* and houses a crankshaft 50 to be rotatable therein. The crankshaft 50 is connected to the piston 14 through a connecting rod 14*a* and rotated with the movement of the piston 14.

A camshaft (not shown) is rotatably housed in the crankcase to be parallel with the crankshaft 50 and connected via a gear mechanism (not shown) to the crankshaft 50 to be driven thereby. The camshaft is equipped with an intake cam and exhaust cam to open/close the intake valve 40 and exhaust valve 44 through a push rod and rocker arms (neither shown).

One end of the crankshaft 50 is attached with a flywheel 52. A pulsar coil (crank angle sensor) 54 is attached to the crankcase outside the flywheel 52. The pulsar coil 54 is rotated relative to a magnet (permanent magnet piece; not shown) attached on a top surface of the flywheel 52 and crosses the flux of the magnet, so that it produces one output per one rotation (360 degrees) of the crankshaft 50 at a predetermined crank angle near the top dead center.

Power coils (generator coils) 56 are attached in the inside of the crankcase and are rotated relative to eight magnets (permanent magnet piece; not shown) attached on a back surface of the flywheel 52 to produce electromotive forces by crossing the flux of the magnets. Thus the power coils 56 function as an Alternating-Current Generator (ACG). The produced electromotive force is rectified and then supplied to a battery (not shown) to charge it.

The other end of the crankshaft 50 is connected to a load 60 such as an operating machine. In the embodiments, a term of "load" means a machine or equipment that consumes power or energy (output) generated by a prime mover, or an amount or magnitude of power consumed by the machine.

An accelerator lever 62 is installed at an appropriate position on a housing (not shown) of the engine 10 to be manipulated by the operator (user). The lever 62 comprises a knob to be pinched by the operator's fingers, so that the operator can input a command for establishing a desired engine speed Nd by turning the knob within a range between predefined minimum and maximum engine speeds.

The throttle valve 22 is connected to an electric motor (actuator, more exactly, a stepper motor) 64. The motor 64 opens/closes or regulates the throttle valve 22 independently from the manipulation of the accelerator lever 62 by the operator. Specifically, the throttle valve 22 is of a Drive-By-Wire type.

An intake air temperature sensor 70 comprising a thermistor or the like is installed in the air intake pipe 20 at the upstream of the throttle valve 22 and produces an output or signal indicative of a temperature of intake air flowing therethrough. An engine temperature sensor 72 comprising a thermistor or the like is installed at the cylinder block 10*a* at a position near the cylinder head 10*b* and produces an output or signal indicative of a temperature of the installed position, i.e., a temperature T of the engine 10 (engine temperature, more precisely a temperature of the cylinder head 10*b*).

A spark plug seat temperature sensor 73 is attached to the spark plug 42, i.e., a spark plug seat (seat section) 42*a* thereof which contacts the cylinder head 10*b* and produces an output or signal indicative of a temperature Ta of the spark plug seat 42*a*.

A variable resistor (potentiometer) 74 is connected to the accelerator lever 62 to produce an output or signal representing the desired engine speed Nd set by the operator through the manipulation of the lever 62. A manipulation switch 76 to be manipulated by the operator is installed at an appropriate position on the housing of the engine 10.

The manipulation switch 76 produces an output or signal indicating an operation command when being manipulated to an ON position (made ON) by the operator and a stop command when being manipulated to an OFF position (made OFF).

The outputs of the foregoing sensors 70, 72, 73, 74, switch 76, pulsar coil 54 and power coils 56 are sent to an Electronic Control Unit (ECU) 80 that has a microcomputer including a CPU, ROM, RAM and input/output circuits. Based on the outputs, the ECU 80 controls the operation of the injector 24, spark plug 42, motor 64, etc.

Figure 2:
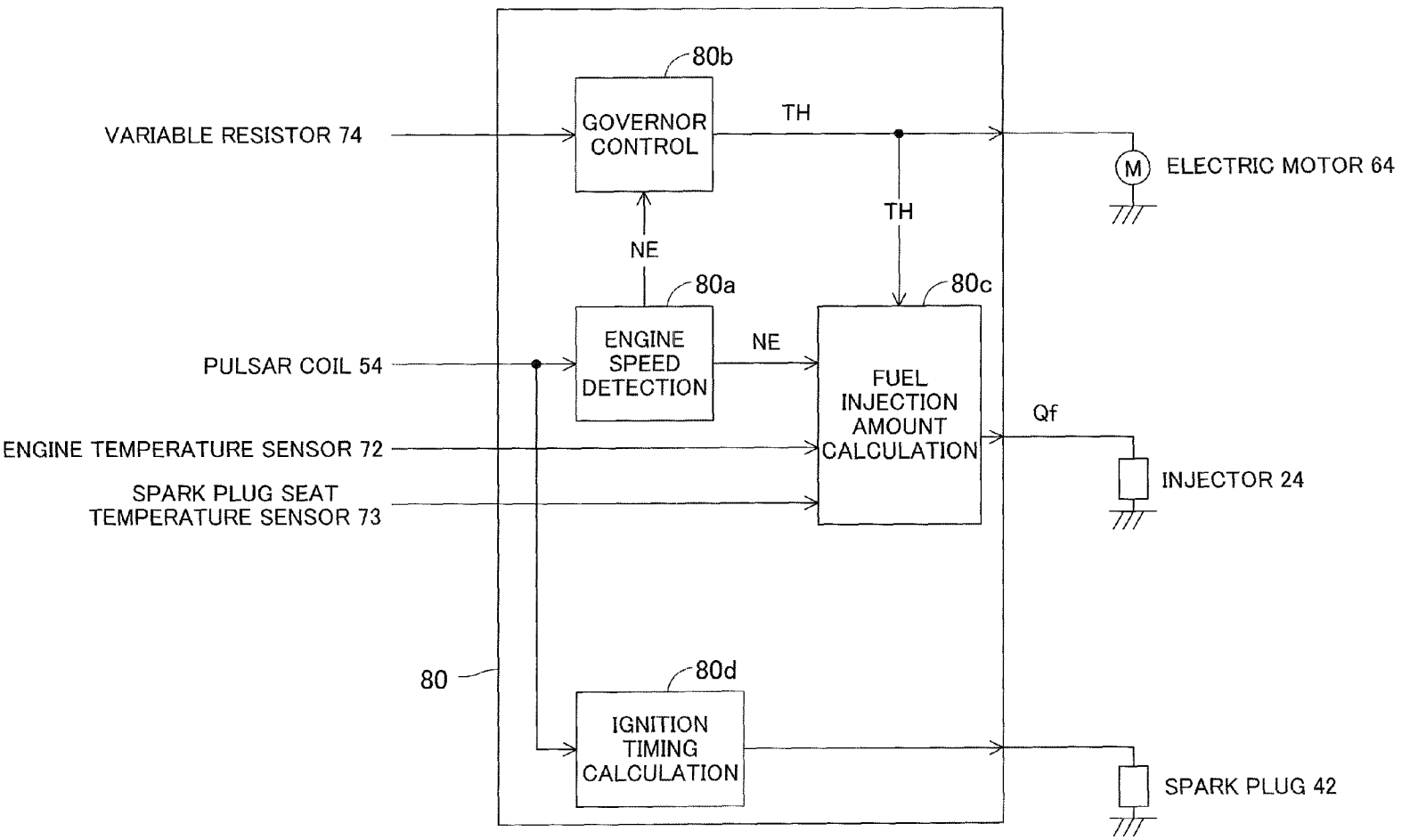
FIG. 2 is a block diagram mainly showing the configuration of an Electronic Control Unit (ECU) shown in FIG. 1.

FIG. 2 is a block diagram mainly showing the configuration of the ECU 80. The ECU 80 comprises an engine speed detection block 80*a*, governor control block 80*b*, fuel injection amount calculation block 80*c* and ignition timing calculation block 80*d*.

The engine speed detection block 80*a* counts outputs of the pulsar coil 54 to detect the engine speed NE. The engine speed NE may be detected using the outputs of the power coils 56.

The governor control block 80*b* determines the desired engine speed Nd of the engine 10 based on the output of the variable resistor 74 produced in response to the manipulation of the lever 62 and regulates a throttle opening by opening/closing the throttle valve 22 through the motor 64 so that the engine speed NE inputted from the engine speed detection block 80*a* becomes (converges to) the desired engine speed Nd.

Specifically, when the detected engine speed NE is lower than the desired engine speed Nd, the governor control block 80*b* outputs a throttle opening command value TH that is increased from a present value TH by a predetermined opening. In contrast, when the engine speed NE is higher than the desired engine speed Nd, it outputs the throttle opening command value TH that is decreased from the present value TH by a predetermined opening. The outputted throttle opening command value TH is sent to the motor 64 so that the throttle opening is regulated through the motor 64. In other words, the engine 10 according to the embodiments includes an electronic governor having the motor 64, ECU 80, etc.

Since the ECU 80 thus instructs a rotational amount of the motor 64, it can calculate or detect the opening of the throttle valve 22 (throttle opening) based on the command value TH produced by itself, without a throttle opening sensor. The throttle opening is calculated by obtaining a percentage when defining the fully-closed position or thereabout as 0 and the fully-opened position or thereabout as 100.

The fuel injection amount calculation block 80*c* calculates a basic fuel injection amount based on the engine speed NE detected by the engine speed detection block 80*a* and the throttle opening command value TH inputted from the governor control block 80*b* in accordance with a fuel injection amount map (mapped data; characteristics) set beforehand, i.e., by using a method called a throttle speed method.

Further, during the warm-up operation, the fuel injection amount calculation block 80*c* detects the engine temperature T based on the output of the engine temperature sensor 72, while detecting the spark plug seat temperature Ta based on the output of the spark plug seat temperature sensor 73, and calculates a warm-up correction coefficient based on the detected temperatures T and Ta.

To be specific, the block 80*c* calculates a warm-up correction coefficient initial value (initial value) and warm-up correction coefficient decreasing amount by retrieving a warm-up correction coefficient initial value map (mapped data; characteristics) and warm-up correction coefficient decreasing amount map (mapped values; characteristics) using the engine temperature T, and calculates a spark plug seat temperature correction coefficient by retrieving a spark plug seat temperature correction coefficient map (mapped data; characteristics) using the spark plug seat temperature T. Those three maps are set beforehand.

The block 80*c* obtains the warm-up correction coefficient based on the warm-up correction coefficient initial value, warm-up correction coefficient decreasing amount and spark plug seat temperature correction coefficient, calculates a warm-up time fuel injection amount by multiplying the basic fuel injection amount by the warm-up correction coefficient, and then sends the calculation result as a final fuel injection amount command value Qf to the injector 24. The injector 24 remains open for a period determined by the sent command value Qf to inject the fuel. The calculation of the warm-up time fuel injection amount will be explained later.

The ignition timing calculation block 80*d* calculates the ignition timing based on the output of the pulsar coil 54, etc., and controls the ignition operation of the spark plug 42 through an ignition device 82 such as an ignition coil. The fuel injection and ignition operation are carried out in response to the output of the pulsar coil 54.

Figure 3:
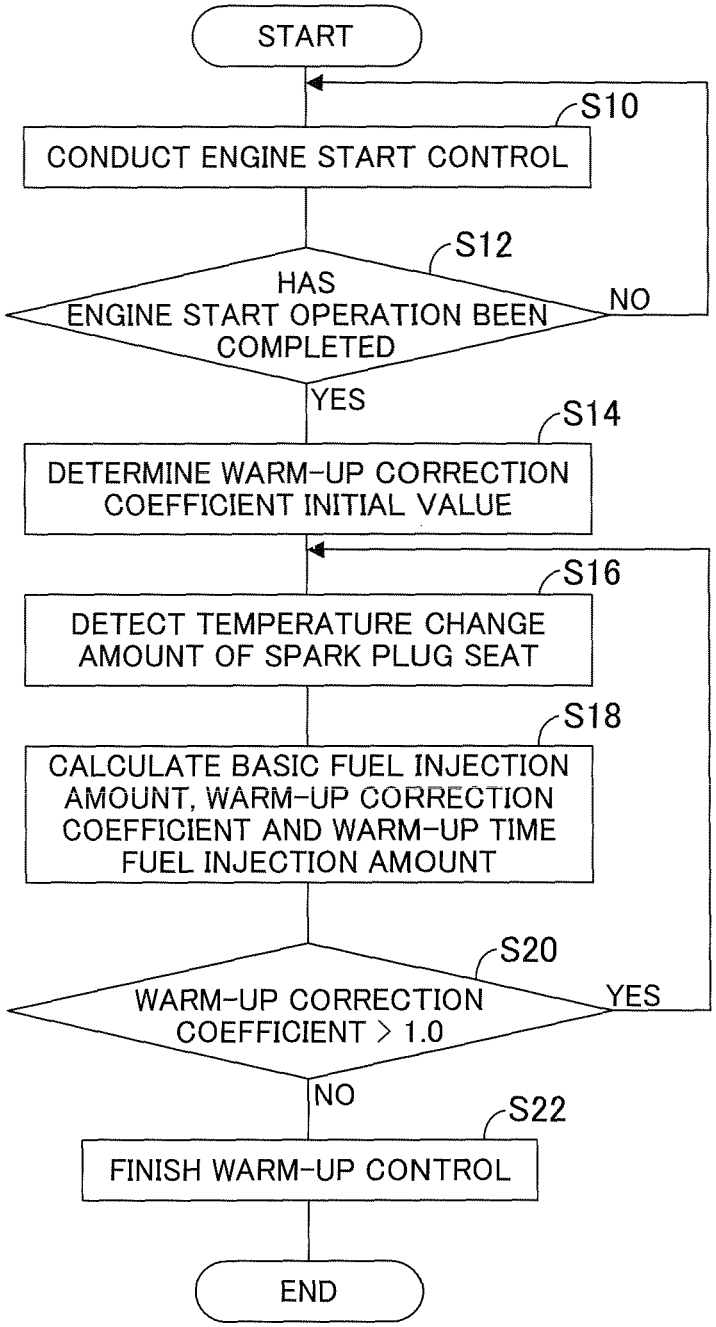
FIG. 3 is a flowchart showing fuel injection amount warm-up correction processing of the apparatus shown in FIG. 1.

FIG. 3 is a flowchart showing fuel injection amount warm-up correction processing conducted from when the manipulation switch 76 is made ON until when the warm-up operation of the engine 10 is completed, among the operation executed by the ECU 80.

The program begins at S(step)10, in which engine start control for injecting the fuel from the injector 24 by a start fuel injection amount calculated based on the engine temperature T is conducted to increase the fuel injection amount. Specifically, the start fuel injection amount is calculated by retrieving a start fuel injection amount map (mapped data, characteristics) shown in FIG. 4 using the engine temperature T at the beginning of the engine start, and the fuel is injected from the injector 24 by the calculated start fuel injection amount. The start fuel injection amount is an amount necessary for the start operation of the engine 10 and, as illustrated, set to be decreased stepwise or in stages with increasing temperature T.

Next the program proceeds to S12, in which it is determined whether the start operation of the engine 10 has been completed, i.e., whether the engine speed NE has reached the self-rotational speed (e.g., 1000 rpm). When the result in S12 is negative, the program returns to S10, while, when the result is affirmative, proceeding to S14 onward. The processing of S14 to S20 represents the warm-up control for heating the engine 10 by increasing the fuel injection amount.

In the warm-up control, first in S14, the warm-up correction coefficient initial value is determined by retrieving the warm-up correction coefficient initial value map shown in FIG. 5 using the engine temperature T. As illustrated, the initial value composed of a multiplication term equal to or greater than 1.0 is set to be gradually decreased with increasing temperature T.

Next the program proceeds to S16, in which a temperature change amount [° C./sec] of the spark plug seat 42*a* per unit time (i.e., 1 second) is detected and to S18, in which the warm-up correction coefficient is calculated based on the basic fuel injection amount, detected temperature change amount, etc., and the warm-up time fuel injection amount is calculated by correcting the basic fuel injection amount with the calculated warm-up correction coefficient so that the fuel is injected from the injector 24 by the calculated amount.

Specifically, the warm-up time fuel injection amount is calculated through the following Equation 1.

$$\text{Warm-up time fuel injection amount} = \text{Basic fuel injection amount} \times \text{Warm-up correction coefficient} \quad \text{Eq. 1}$$

In the above equation, the warm-up correction coefficient is calculated through the following Equations 2 and 3.

$$\text{Warm-up correction coefficient} = \text{Warm-up correction coefficient initial value} - \text{Final warm-up correction coefficient decreasing amount} \quad \text{Eq. 2}$$

Final warm-up correction coefficient decreasing amount=Warm-up correction coefficient decreasing amount×Spark plug seat temperature correction coefficient Eq. 3

The basic fuel injection amount of the Equation 1 is calculated by retrieving the fuel injection amount map using the throttle opening (precisely, the command value TH) and engine speed NE.

The warm-up correction coefficient is composed of the multiplication term equal to or greater than 1.0 and is calculated so that it decreases from the initial value toward 1.0 by the final warm-up correction coefficient decreasing amount (predetermined value) every time the engine 10 is rotated a predetermined number of times (e.g., once). In other words, the warm-up correction coefficient is calculated through the Equations 2 and 3 every time the engine 10 is rotated the predetermined number of times. Note that, when the coefficient is calculated second or subsequent time, the initial value in the Equation 2 is replaced by a "(previous) warm-up correction coefficient." Further, instead of using the rotation of the engine 10, the warm-up correction coefficient may be calculated so that it decreases by the final warm-up correction coefficient decreasing amount every time a predetermined time period elapses.

The final warm-up correction coefficient decreasing amount is calculated by multiplying the warm-up correction coefficient decreasing amount by the spark plug seat temperature correction coefficient, as indicated by the Equation 3. The warm-up correction coefficient decreasing amount is calculated by retrieving the warm-up correction coefficient decreasing amount map shown in FIG. 5 using the engine temperature T. The decreasing amount is gradually increased in proportion to the increase in the temperature T and becomes 0 when the temperature T is at a value (e.g., 100° C.) which enables to estimate that the warm-up operation has been completed.

Figure 6:
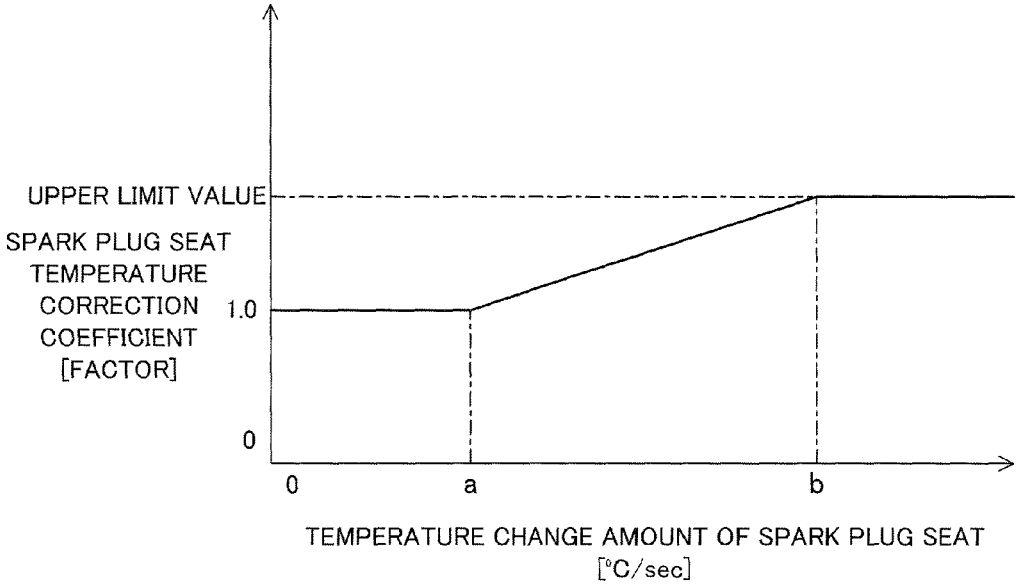
FIG. 6 is a graph showing a map (mapped data) to be used in the processing of the FIG. 3 flowchart.

The spark plug seat temperature correction coefficient is composed of the multiplication term equal to or greater than 1.0 and is calculated by retrieving the spark plug seat temperature correction coefficient map shown in FIG. 6 based on the temperature change amount of the spark plug seat 42*a* detected in S16. As illustrated, the coefficient is 1.0 when the change amount is relatively small (i.e., within a range between 0 and a value a) and when the change amount is equal to or greater than the value a (i.e., when the change amount is relatively large), the coefficient is gradually increased with increasing change amount. The coefficient is to be an upper limit value (e.g., 1.75) when the change amount is equal to or greater than a value b of greater than the value a. As a result, when the change amount is relatively large, the spark plug seat temperature correction coefficient is increased, so that the final warm-up correction coefficient decreasing amount obtained through the Equation 3 is increased. Due to the increase in the decreasing amount, the warm-up correction coefficient is decreased through the Equation 2 and consequently, the warm-up time fuel injection amount is decreased through the Equation 1.

The reason why the warm-up time fuel injection amount is decreased when the change amount is relatively large is explained with reference to FIG. 7.

Figure 7:
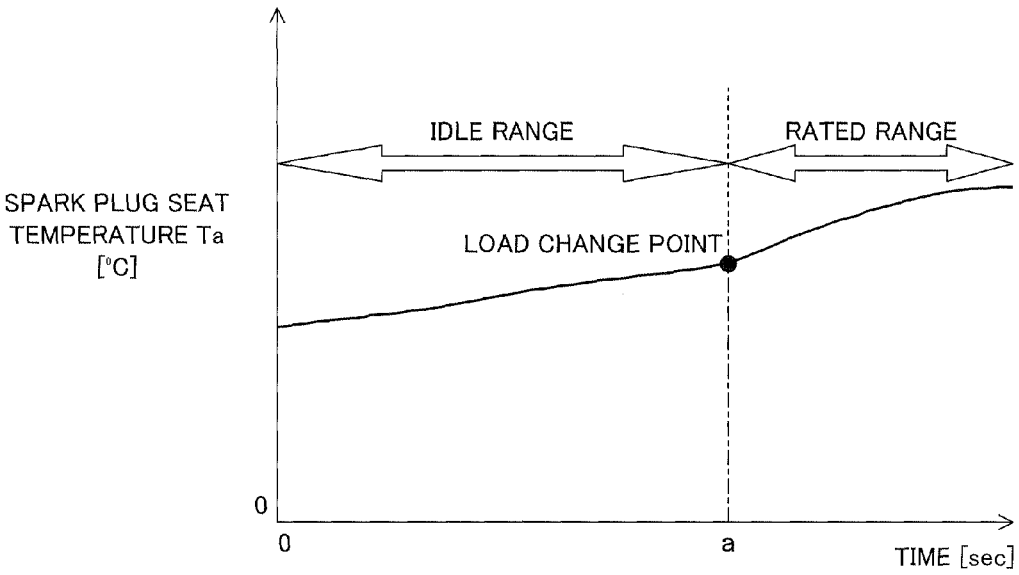
FIG. 7 is a graph showing relationship between a temperature of a spark plug seat and load connected to the engine during warm-up operation of the engine shown in FIG. 1.

FIG. 7 is a graph showing relationship between the spark plug seat temperature Ta and load connected to the engine 10 during the warm-up operation. In FIG. 7, a period of the time 0 to time a corresponds to a condition where the engine speed NE remains constant and the load acting on the engine 10 is small, i.e., the engine is in the idle range, while a period after the time a corresponds to a condition where the engine speed NE remains constant and the load acts on the engine 10, i.e., the engine 10 is in the rated operation range.

As illustrated, when the engine 10 is in the idle range, since thermal energy generated through the combustion in the combustion chamber 16 is relatively small, the increase (inclination) of the temperature Ta of the spark plug seat 42*a* transferred with the thermal energy is to be moderate, i.e., the temperature change amount is to be relatively small. In contrast, when the engine 10 is in the rated opertion range, since the thermal energy generated through the combustion in the combustion chamber 16 is relatively large, the increase (inclination) of the temperature Ta is to be drastic (sharp), i.e., the temperature change amount is to be relatively large. Also, although not illustrated, since the thermal energy is increased with higher load, the temperature change amount is further increased in response to the increase in the load.

Under the above premise, when the temperature change amount of the spark plug seat 42*a* is detected, it makes possible to estimate the level of load and the magnitude of thermal energy generated through the combustion. Therefore, in the case where the temperature change amount is large so that the load and thermal energy are estimated to be high, since the engine warm-up operation is promoted (goes well) in proportion to the generated thermal energy, the warm-up time fuel injection amount can be decreased from its first-calculated value.

Thus, since the warm-up operation goes well when the temperature change amount is relatively large, in S18, the spark plug seat temperature correction coefficient is increased in accordance with the progress of the warm-up operation as mentioned above to increase the final warm-up correction coefficient decreasing amount, so that the warm-up time fuel injection amount calculated by the Equation 1 is decreased.

In the FIG. 3 flowchart, the program proceeds to S20, in which it is determined whether the present warm-up correction coefficient is greater than 1.0. When the result in S20 is affirmative, the program returns to S16 and when the result is negative, i.e., when the warm-up correction coefficient is decreased to a value at or below 1.0 through the Equation 2, the program proceeds to S22, in which the warm-up control is finished and the program is terminated. In other words, the warm-up operation is continued until the warm-up correction coefficient reaches 1.0. Although the normal fuel injection control is performed after the warm-up operation, since it is not directly related to the gist of this invention, the explanation thereof is omitted.

Figure 8:
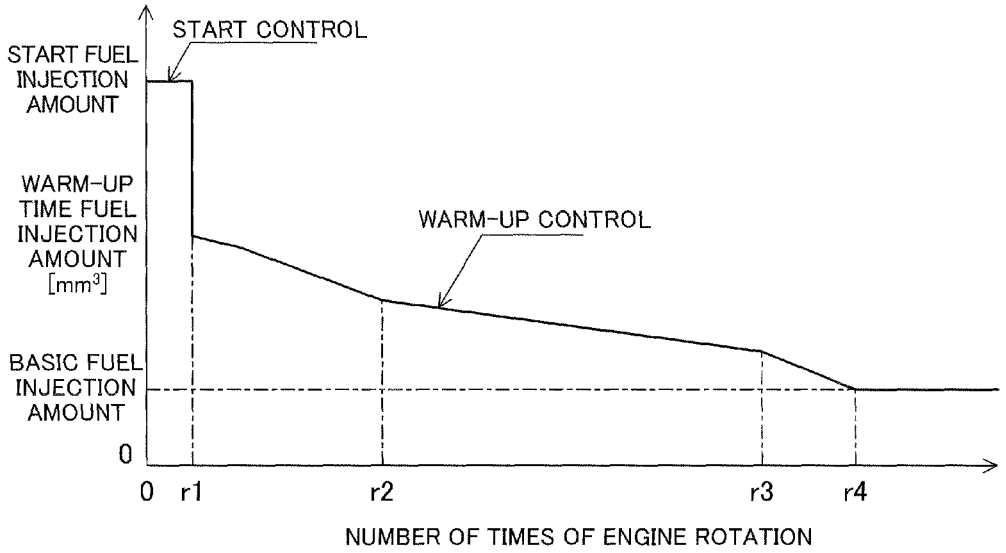
FIG. 8 is a graph for explaining the processing of the FIG. 3 flowchart.

FIG. 8 is a graph for explaining the foregoing processing. The abscissa indicates the number of times of the engine rotation.

First, when the manipulation switch 76 is made ON with the engine 10 being stopped, the start control for injecting the fuel from the injector 24 by the start fuel injection amount is conducted (S10). Next, when the engine start operation is completed after the engine 10 is rotated, for example, r1 times (S12), the warm-up control is started in which the warm-up time fuel injection amount is calculated by correcting the basic fuel injection amount with the warm-up correction coefficient calculated based on the temperature change amount of the spark plug seat 42*a* and the fuel is injected from the injector 24 by the calculated amount (S16, S18).

Since the warm-up correction coefficient is calculated so that it decreases from the initial value by the final warm-up correction coefficient decreasing amount every time the engine 10 is rotated the predetermined number of times, the warm-up time fuel injection amount is gradually decreased accordingly.

Further, in the case where the temperature change amount is changed upon the engine rotation of, for instance, r2 or r3 times, i.e., the engine warm-up condition (progress) is changed in response to variation in the load, the spark plug seat temperature correction coefficient is increased/decreased in accordance with the change so that the final warm-up correction coefficient decreasing amount is increased/decreased, whereby the warm-up time fuel injection amount suitable for the warm-up condition is calculated and the fuel is injected from the injector 24 by the calculated amount.

Then when the engine 10 is rotated r4 times and the warm-up correction coefficient reaches 1.0 so that the warm-up time fuel injection amount becomes the same as the basic fuel injection amount, the warm-up control is finished. In other words, the warm-up control is continued until the coefficient reaches 1.0 (S20, S22).

As set out in the foregoing, in the first embodiment, the basic fuel injection amount is calculated based on the engine speed NE and the throttle opening TH, and the warm-up time fuel injection amount is calculated by correcting the basic fuel injection amount based on one of the temperature change amount of the spark plug seat 42*a* of the engine 10, the throttle opening and the output of the operating machine, specifically on the temperature change amount of the spark plug seat 42*a*, and fuel is injected from the injector 24 by the calculated warm-up time fuel injection amount. With this, it becomes possible to calculate the fuel injection amount suitable for the engine warm-up condition (progress), thereby enabling to shorten the warm-up operation time and decrease fuel consumption.

Further, even when the engine 10 comprises the air-cooled general purpose engine whose warm-up condition (progress) is easily influenced by the ambient temperature, owing to the above configuration, it becomes possible to calculate the appropriate fuel injection amount in accordance with the warm-up condition.

Furthermore, since the warm-up correction coefficient is calculated based on the temperature change amount of the spark plug seat 42*a* and the warm-up time fuel injection amount is calculated by correcting the basic fuel injection amount with the calculated warm-up correction coefficient after start operation of the engine 10 is completed. With this, the appropriate fuel injection amount can be calculated using the warm-up correction coefficient corresponding to the engine warm-up condition, thereby enabling to further shorten the warm-up operation time and further decrease fuel consumption.

Furthermore, the warm-up correction coefficient is calculated such that it decreases from the warm-up correction coefficient initial value by the final warm-up correction coefficient decreasing amount calculated based on the temperature change amount. With this, since the warm-up correction coefficient can be decreased gradually (in stages) as the engine 10 is warmed up, it becomes possible to calculate the appropriate fuel injection amount in accordance with the engine warm-up condition.

Furthermore, the warm-up correction coefficient is calculated every time the engine 10 is rotated a predetermined number of times or every time a predetermined time period elapses. With this, since the warm-up correction coefficient can be reliably decreased with time, i.e., as the engine 10 is warmed up, it becomes possible to calculate the further appropriate fuel injection amount in accordance with the engine warm-up condition.

Furthermore, the warm-up correction coefficient is composed of a multiplication term equal to or greater than 1.0 and is calculated such that it decreases toward 1.0 by the predetermined value every time the engine is rotated a predetermined number of times or every time a predetermined time period elapses, and the warm-up operation is continued until the warm-up correction coefficient reaches 1.0.

With this, the warm-up correction coefficient can be gradually decreased toward 1.0 as the engine 10 is warmed up and consequently, it becomes possible to calculate the further appropriate fuel injection amount in accordance with the engine warm-up condition. Also, since the warm-up control is continued until the coefficient reaches 1.0, the warm-up operation can be finished at the right time, i.e., when it is completed.

Furthermore, the engine 10 has the actuator (electric motor) 64 adapted to open and close the throttle valve 22 such that the speed NE of the engine is converged to a desired engine speed Nd set by an operator, i.e., has the electronic governor. With this, since the throttle opening can be calculated (detected) based on the command value TH used for operating the actuator 64, a throttle opening sensor is not necessary and it becomes possible to calculate the fuel injection amount suitable for the warm-up condition of the engine 10 with the simple structure.

A warm-up control apparatus for a general-purpose engine according to a second embodiment will be next explained.

Figure 9:
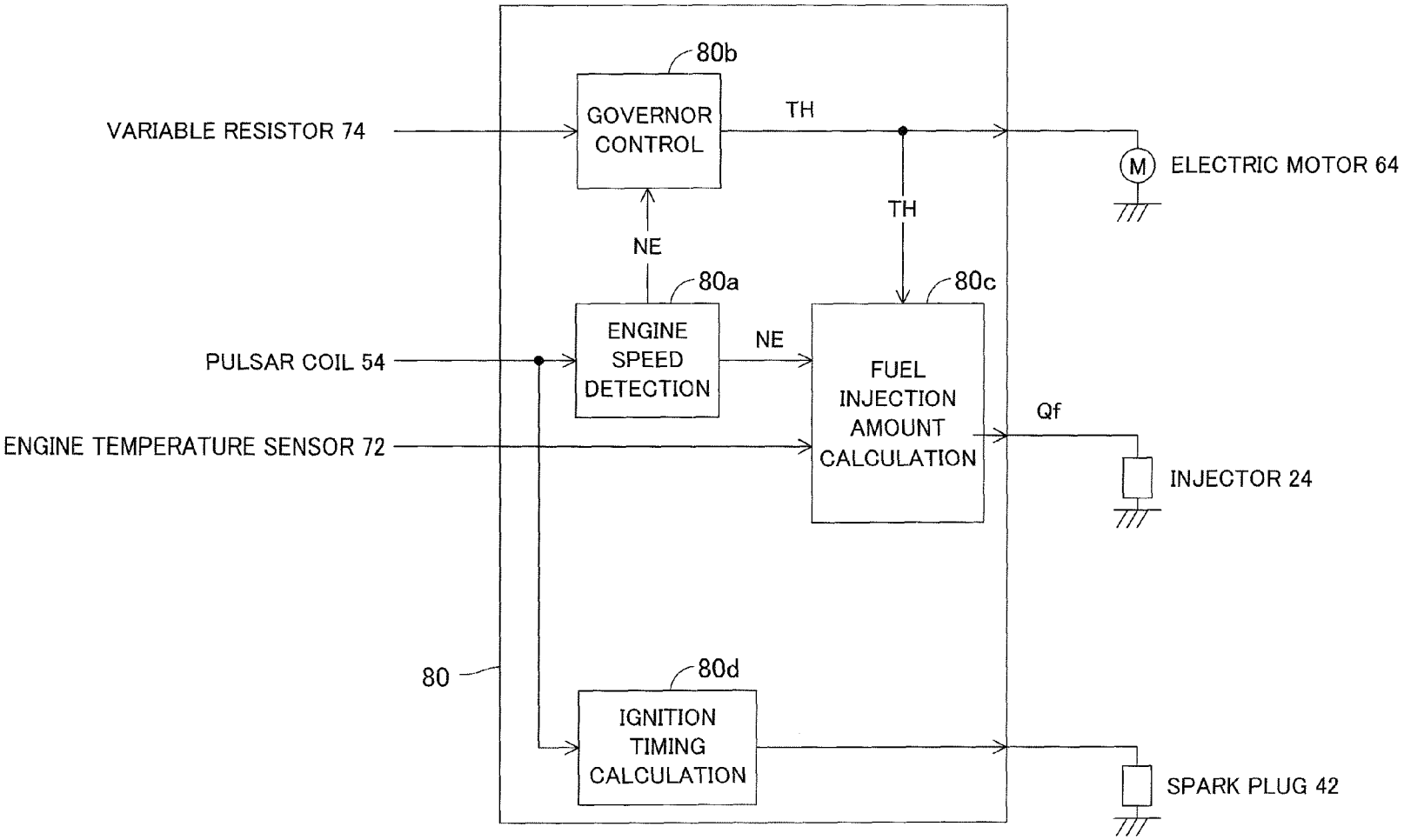
FIG. 9 is a block diagram similar to FIG. 2, but mainly showing the configuration of an Electronic Control Unit (ECU) in a warm-up control apparatus for a general-purpose engine according to a second embodiment.

FIG. 9 is a block diagram similar to FIG. 2, but mainly showing the configuration of the ECU 80 in the apparatus according to the second embodiment. Constituent elements corresponding to those of the first embodiment are assigned by the same reference symbols and will not be explained.

The explanation will be made with focus on points of difference from the first embodiment. In the second embodiment, the warm-up time fuel injection amount is calculated based on not the temperature change amount of the spark plug seat but the throttle opening.

As shown in FIG. 9, during the warm-up operation, the fuel injection amount calculation block 80*c* detects the engine temperature T based on the output of the engine temperature sensor 72, while calculating the warm-up correction coefficient based on the detected engine temperature T and throttle opening (precisely, the throttle opening command value TH).

To be specific, similarly to the first embodiment, the fuel injection amount calculation block 80*c* calculates the warm-up correction coefficient initial value and warm-up correction coefficient decreasing amount by retrieving the warm-up correction coefficient initial value map and warm-up correction coefficient decreasing amount map, and calculates a throttle opening correction coefficient by retrieving a throttle opening correction coefficient map (mapped data; characteristics) set beforehand using the throttle opening. Then it calculates the warm-up time fuel injection amount based on the obtained values, which will be explained later.

Figure 10:
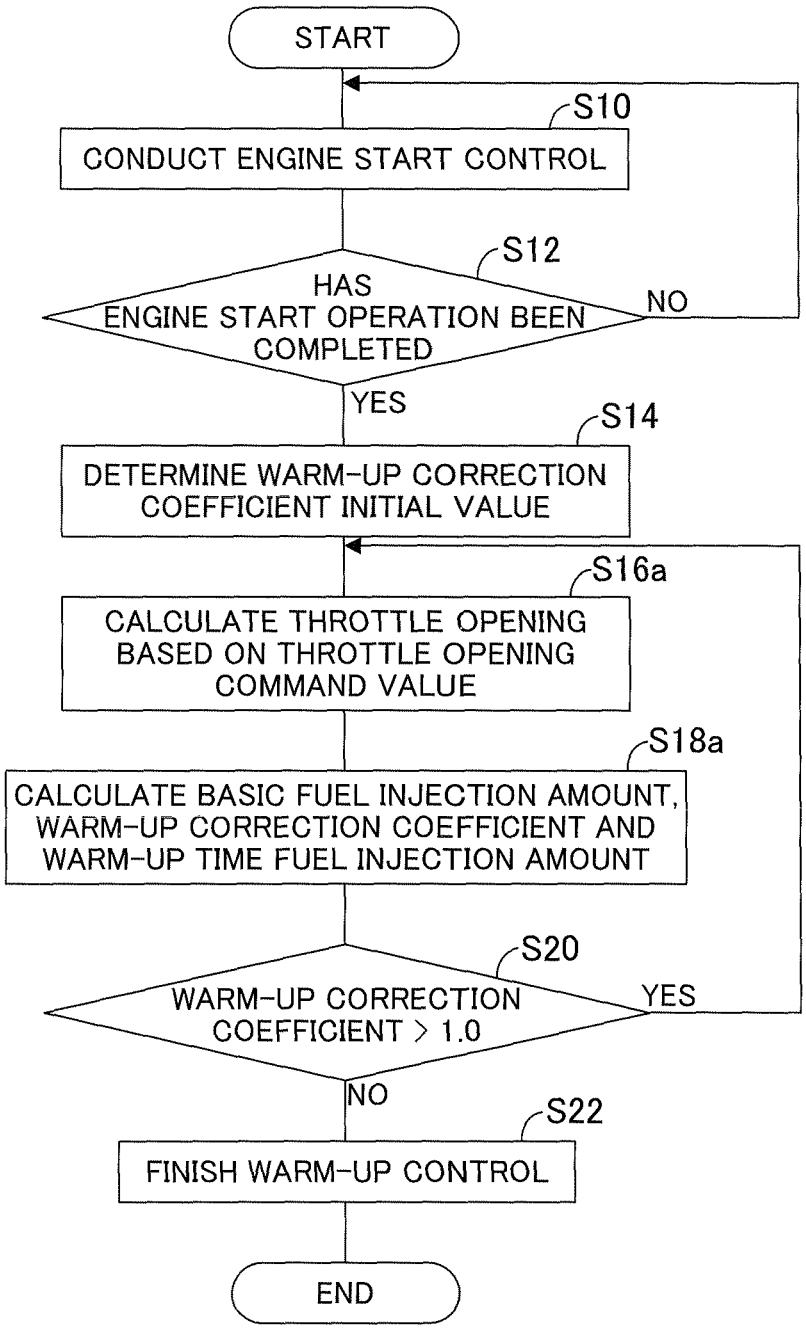
FIG. 10 is a flowchart similar to FIG. 3, but showing fuel injection amount warm-up correction processing of the apparatus according to the second embodiment.

FIG. 10 is a flowchart similar to FIG. 3, but showing fuel injection amount warm-up correction processing of the apparatus according to the second embodiment.

After the processing of S10 to S14, the program proceeds to S16*a*, in which the throttle opening is calculated or detected based on the throttle opening command value TH and to S18*a*, in which the basic fuel injection amount and warm-up correction coefficient are calculated based on the throttle opening, etc., and the warm-up time fuel injection amount is calculated by correcting the basic fuel injection amount with the calculated warm-up correction coefficient so that the fuel is injected from the injector 24 by the calculated amount.

Specifically, the warm-up time fuel injection amount is calculated through the following Equation 1.

Warm-up time fuel injection amount=Basic fuel injection amount×Warm-up correction coefficient Eq. 1

In the above equation, the warm-up correction coefficient is calculated through the following Equations 2 and 4.

Warm-up correction coefficient=Warm-up correction coefficient initial value−Final warm-up correction coefficient decreasing amount Eq. 2

Final warm-up correction coefficient decreasing amount=Warm-up correction coefficient decreasing amount×Throttle opening correction coefficient Eq. 4

The Equations 1 and 2 are the same as those in the first embodiment. The final warm-up correction coefficient decreasing amount is calculated by multiplying the warm-up correction coefficient decreasing amount by the throttle opening correction coefficient, as indicated by the Equation 4.

Figure 11:
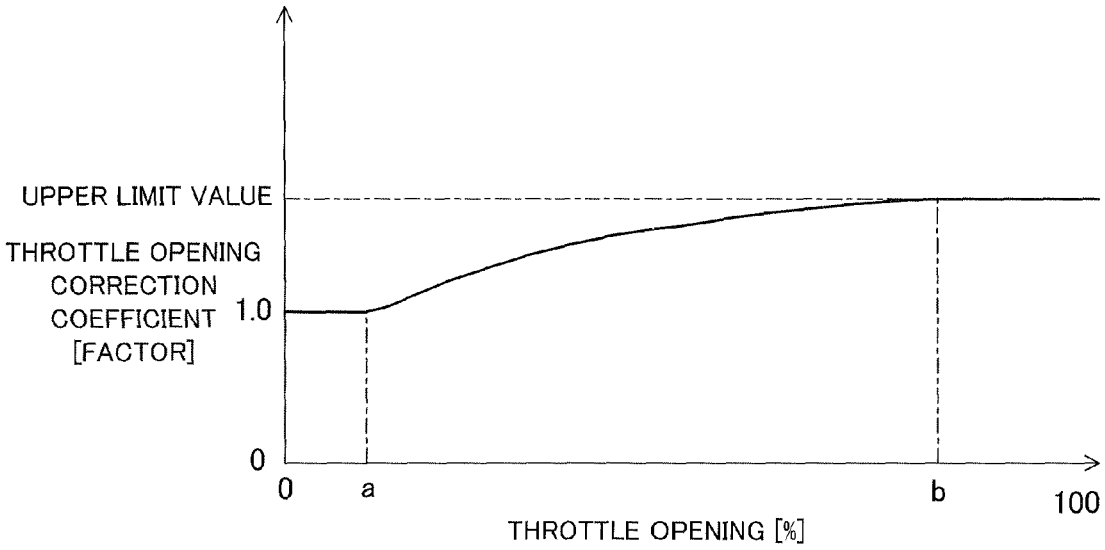
FIG. 11 is a graph showing a map (mapped data) to be used in the processing of the FIG. 10 flowchart.

The throttle opening correction coefficient is composed of the multiplication term equal to or greater than 1.0 and is calculated by retrieving the throttle opening correction coefficient map shown in FIG. 11 based on the throttle opening calculated in S16*a*. As illustrated, the coefficient is 1.0 when the throttle opening is relatively small (i.e. at an idle opening position or thereabout in the vicinity of the fully-closed position (more exactly, within a range between 0 and a value a)) and when the throttle opening is equal to or greater than the value a (i.e., when the throttle opening is relatively large), the coefficient is gradually increased with increasing throttle opening. The coefficient is to be an upper limit value (e.g., 1.75) when the throttle opening is equal to or greater than a value b of greater than the value a, i.e., set on the wide-open side of the value a.

As a result, when the throttle opening is relatively large, the throttle opening correction coefficient is increased, so that the final warm-up correction coefficient decreasing amount obtained through the Equation 4 is increased. Due to the increase in the decreasing amount, the warm-up correction coefficient is decreased through the Equation 2 and consequently, the warm-up time fuel injection amount is decreased through the Equation 1.

The reason why the warm-up time fuel injection amount is decreased when the throttle opening is relatively large is explained. The throttle opening is correlated with load connected to the engine 10. Specifically, when the load is changed in the increasing direction, in order to keep the engine speed NE constant at the desired engine speed Nd, the throttle opening is regulated by the electronic governor to increase in the opening direction. In contrast, when the load is decreased, the throttle opening is regulated to decrease in the closing direction.

In other words, the thermal energy generated through the combustion in the combustion chamber 16 is to be relatively large with the high load and relatively large throttle opening, whilst the thermal energy is to be relatively small with the low load and relatively small throttle opening.

Under the above premise, based on the throttle opening of the engine 10, the level of load and the magnitude of thermal energy generated through the combustion can be estimated. Therefore, in the case where the throttle opening is large so that the load and thermal energy are estimated to be high, since the engine warm-up operation is promoted (goes well) in proportion to the generated thermal energy, the warm-up time fuel injection amount can be decreased from its first-calculated value.

Thus, since the warm-up operation goes well when the throttle opening is relatively large, in S18*a*, the throttle opening correction coefficient is increased in accordance with the progress of the warm-up operation as mentioned above to increase the final warm-up correction coefficient decreasing amount, so that the warm-up time fuel injection amount calculated by the Equation 1 is decreased.

After that, the processing of S20 and S22 is conducted and the program is terminated.

It should be noted that a graph for explaining the above operation is basically the same as FIG. 8. Specifically, as shown in FIG. 8, when the engine start operation is completed after the engine 10 is rotated, for example, r1 times (S12), the warm-up control is started in which the warm-up time fuel injection amount is calculated by correcting the basic fuel injection amount with the warm-up correction coefficient calculated based on the throttle opening and the fuel is injected from the injector 24 by the calculated amount (S16*a*, S18*a*).

The warm-up time fuel injection amount is gradually decreased every time the engine 10 is rotated the predetermined number of times. In the case where the throttle opening is changed upon the engine rotation of, for instance, r2 or r3 times, i.e., the engine warm-up condition (progress) is changed in response to variation in the load, the throttle opening correction coefficient is increased/decreased in accordance with the change so that the final warm-up correction coefficient decreasing amount is increased/decreased, whereby the warm-up time fuel injection amount suitable for the warm-up condition is calculated and the fuel is injected from the injector 24 by the calculated amount.

Then when the engine 10 is rotated r4 times and the warm-up correction coefficient reaches 1.0, the warm-up control is finished (S20, S22).

As set out in the foregoing, in the second embodiment, the basic fuel injection amount is calculated based on the engine speed NE and the throttle opening TH, and the warm-up time fuel injection amount is calculated by correcting the basic fuel injection amount based on one of the temperature change amount of the spark plug seat 42*a* of the engine 10, the throttle opening and the output of the operating machine, specifically on the throttle opening TH, and fuel is injected from the injector 24 by the calculated warm-up time fuel injection amount.

More specifically, the warm-up time fuel injection amount is calculated based on, in place of the lubricating oil temperature, the throttle opening TH that influences the engine warm-up condition. With this, it becomes possible to calculate the fuel injection amount suitable for the engine warm-up condition (progress), thereby enabling to shorten the warm-up operation time and decrease fuel consumption.

Further, the warm-up correction coefficient is calculated based on the throttle opening TH and the warm-up time fuel injection amount is calculated by correcting the basic fuel injection amount with the calculated warm-up correction coefficient after start operation of the engine 10 is completed. With this, the appropriate fuel injection amount can be calculated using the warm-up correction coefficient corresponding to the engine warm-up condition, thereby enabling to further shorten the warm-up operation time and further decrease fuel consumption.

Furthermore, warm-up correction coefficient is calculated such that it decreases from the warm-up correction coefficient initial value by the final warm-up correction coefficient decreasing amount calculated based on the throttle opening TH. With this, since the warm-up correction coefficient can be decreased gradually (in stages) as the engine 10 is warmed up, it becomes possible to calculate the appropriate fuel injection amount in accordance with the engine warm-up condition.

The remaining configuration and effects are the same as those in the first embodiment.

A warm-up control apparatus for a general-purpose engine according to a third embodiment will be next explained.

Figure 12:
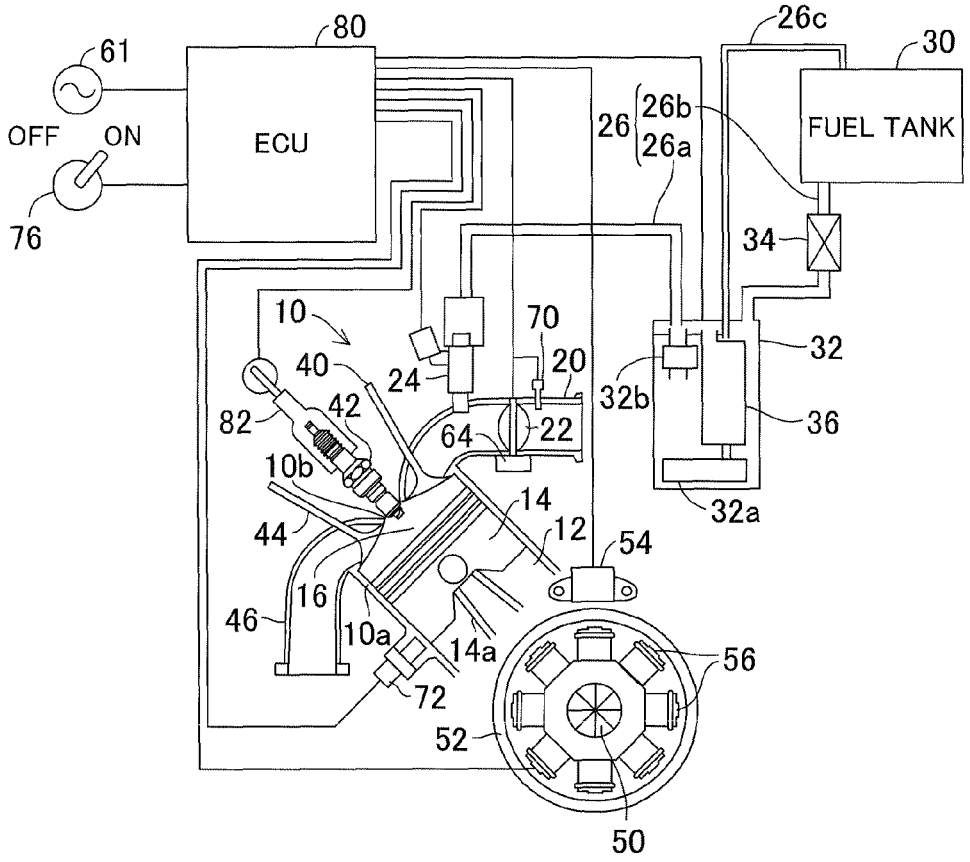
FIG. 12 is an overall view similar to FIG. 1, but schematically showing a warm-up control apparatus for a general-purpose engine according to a third embodiment.

FIG. 12 is an overall view similar to FIG. 1, but schematically showing the apparatus according to the third embodiment. In the third embodiment, the engine 10 is used as a prime mover of a generator. Specifically, the electromotive force generated by the power coil (alternator) 56 is rectified and supplied to the battery to charge it, while rectified direct current is converted to alternating current and supplied to an electric load (e.g., electric power tool) 61 through a connector (not shown) or the like.

Thus the engine 10 is connected to the load such as the power coils 56 that function as a generator (operating machine). The accelerator lever 62 and variable resistor 74 are removed in this embodiment.

Figure 13:
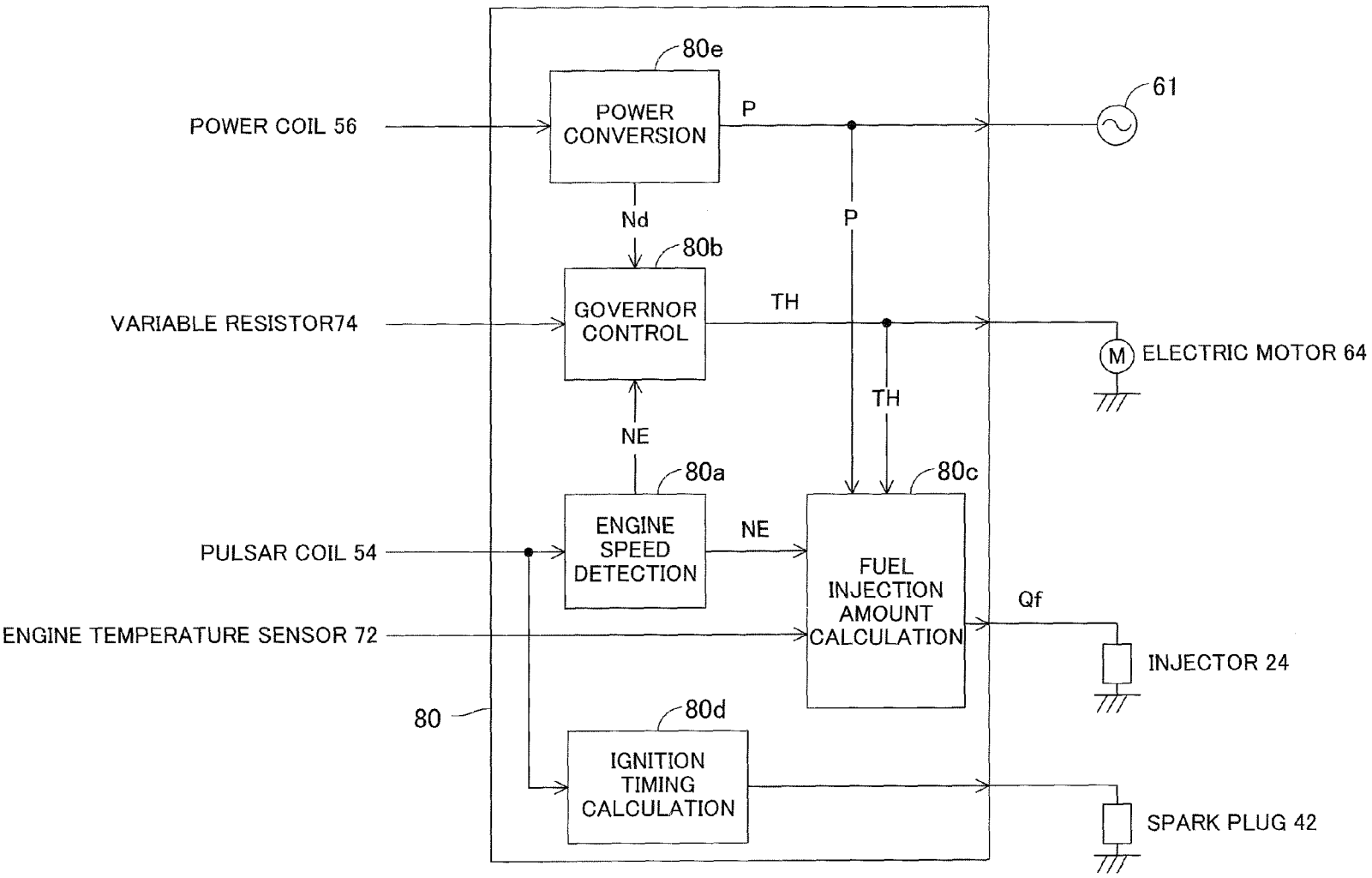
FIG. 13 is a block diagram similar to FIG. 2, but mainly showing the configuration of an Electronic Control Unit (ECU) shown in FIG. 12.

FIG. 13 is a block diagram similar to FIG. 2, but mainly showing the configuration of the ECU 80 shown in FIG. 12. The ECU 80 comprises a power conversion block 80*e* in addition to the aforementioned configuration.

The power conversion block 80*e* rectifies alternating current outputted from the power coils 56 to direct current, boosts the rectified direct current to a predetermined voltage, converts the boosted direct current to alternating current, and then outputs the alternating current as a power output (output of the operating machine) P to the load 61. Further, it determines the desired engine speed Nd in accordance with the power output P, i.e., determines a speed of the engine 10 (desired engine speed) Nd which enables to maintain the power output P based on the output P.

The governor control block 80*b* opens/closes the throttle valve 22 through the motor 64 to regulate the throttle opening so that the engine speed NE inputted from the engine speed detection block 80*a* becomes (converges to) the desired engine speed Nd inputted from the power conversion block 80*e*.

The fuel injection amount calculation block 80*c* detects the engine temperature T based on the output of the engine temperature sensor 72 during the warm-up operation and calculates the warm-up correction coefficient based on the detected engine temperature T and the power output P inputted from the power conversion block 80*e*.

To be specific, similarly to the first embodiment, the fuel injection amount calculation block 80*c* calculates the warm-up correction coefficient initial value and warm-up correction coefficient decreasing amount based on the engine temperature T and calculates a power output correction coefficient by retrieving a power output correction coefficient map (mapped data; characteristics) set beforehand using the power output P. Then it calculates the warm-up time fuel injection amount based on the obtained values, which will be explained later.

Figure 14:
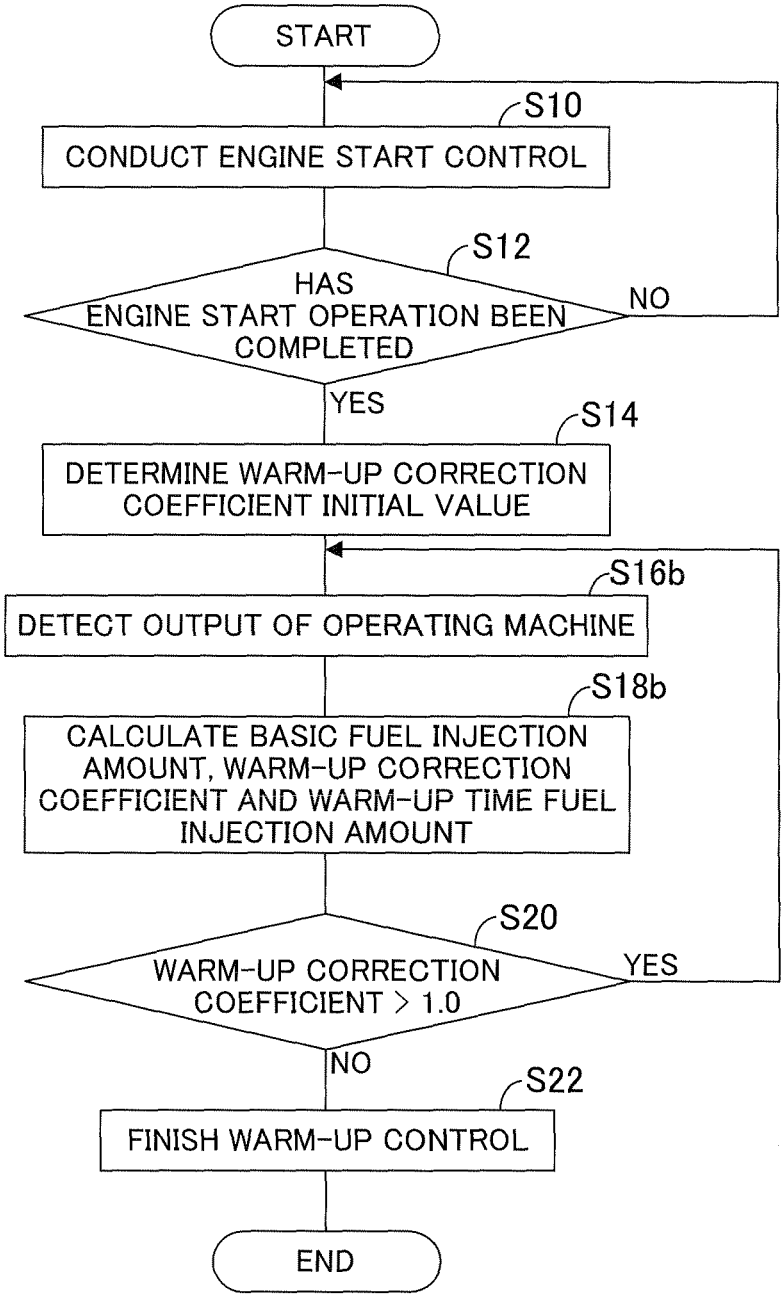
FIG. 14 is a flowchart similar to FIG. 3, but showing fuel injection amount warm-up correction processing of the apparatus shown in FIG. 12.

FIG. 14 is a flowchart similar to FIG. 3, but showing fuel injection amount warm-up correction processing of the apparatus shown in FIG. 12.

After the processing of S10 to S14, the program proceeds to S16*b*, in which the output of the operating machine is detected, i.e., the power output P of the power coils 56 functioning as the generator (operating machine) is detected. Then the program proceeds to S18*b*, in which the warm-up correction coefficient is calculated based on the basic fuel injection amount, power output P, etc., and the warm-up time fuel injection amount is calculated by correcting the basic fuel injection amount with the calculated warm-up correction coefficient so that the fuel is injected from the injector 24 by the calculated amount.

Specifically, the warm-up time fuel injection amount is calculated through the following Equation 1.

$$\text{Warm-up time fuel injection amount} = \text{Basic fuel injection amount} \times \text{Warm-up correction coefficient} \quad \text{Eq. 1}$$

In the above equation, the warm-up correction coefficient is calculated through the following Equations 2 and 5.

$$\text{Warm-up correction coefficient} = \text{Warm-up correction coefficient initial value} - \text{Final warm-up correction coefficient decreasing amount} \quad \text{Eq. 2}$$

$$\text{Final warm-up correction coefficient decreasing amount} = \text{Warm-up correction coefficient decreasing amount} \times \text{Power output correction coefficient} \quad \text{Eq. 5}$$

The Equations 1 and 2 are the same as those in the first embodiment. The final warm-up correction coefficient decreasing amount is calculated by multiplying the warm-up correction coefficient decreasing amount by the power output correction coefficient, as indicated by the Equation 5.

Figure 15:
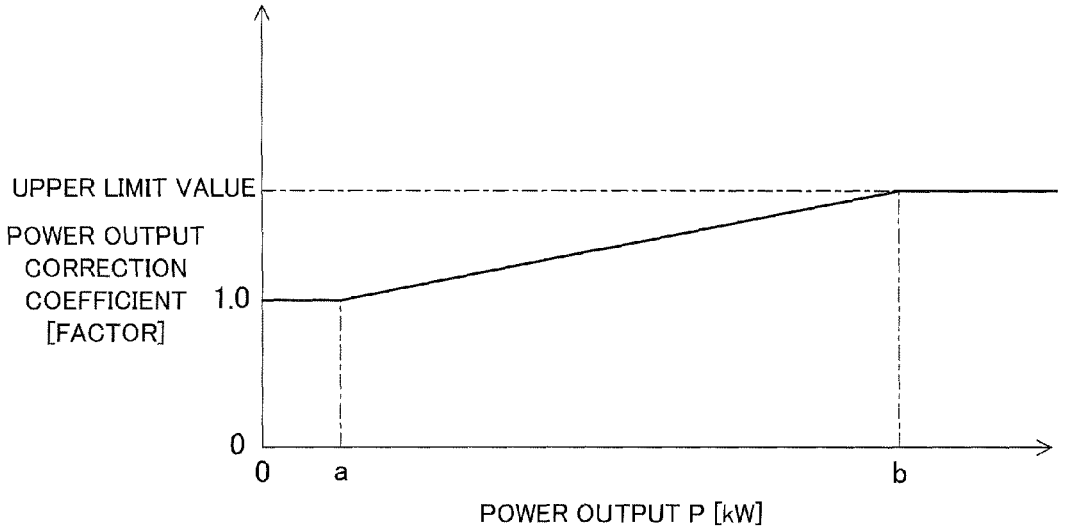
FIG. 15 is a graph showing a map (mapped data) to be used in the processing of the FIG. 14 flowchart.

The power output correction coefficient is composed of the multiplication term equal to or greater than 1.0 and is calculated by retrieving the power output correction coefficient map shown in FIG. 15 based on the power output P detected in S16*b*. As illustrated, the coefficient is 1.0 when the power output P is relatively small (i.e., within a range between 0 and a value a) and when the power output P is equal to or greater than the value a (i.e., when the power output P is relatively large), the coefficient is gradually increased with increasing power output P. The coefficient is to be an upper limit value (e.g., 1.75) when the power output P is equal to or greater than a value b of greater than the value a.

As a result, when the power output P is relatively large, the power output correction coefficient is increased, so that the final warm-up correction coefficient decreasing amount obtained through the Equation 5 is increased. Due to the increase in the decreasing amount, the warm-up correction coefficient is decreased through the Equation 2 and consequently, the warm-up time fuel injection amount is decreased through the Equation 1.

The reason why the warm-up time fuel injection amount is decreased when the power output P is relatively large is explained. When the power output P is relatively large and the load acting on the engine 10 is high, the thermal energy generated through the combustion in the combustion chamber 16 is to be relatively large. In contrast, when the power output P is relatively small and the load is low, the thermal energy is to be relatively small.

Under the above premise, based on the power output P, the level of load and the magnitude of thermal energy generated by the combustion can be estimated. Therefore, when the power output P is large so that the load and thermal energy are estimated to be high, since the engine warm-up operation is promoted (goes well) in proportion to the generated thermal energy, the warm-up time fuel injection amount can be decreased from its first-calculated value.

Thus, since the warm-up operation goes well when the power output P is relatively large, in S18*b*, the power output correction coefficient is increased in accordance with the progress of the warm-up operation as mentioned above to increase the final warm-up correction coefficient decreasing amount, so that the warm-up time fuel injection amount calculated by the Equation 1 is decreased.

After that, the processing of S20 and S22 is conducted and the program is terminated.

It should be noted that a graph for explaining the above operation is basically the same as FIG. 8. Specifically, as shown in FIG. 8, when the engine start operation is completed after the engine 10 is rotated, for example, r1 times (S12), the warm-up control is started in which the warm-up time fuel injection amount is calculated by correcting the basic fuel injection amount with the warm-up correction coefficient calculated based on the power output P and the fuel is injected from the injector 24 by the calculated amount (S16*b*, S18*b*).

The warm-up time fuel injection amount is gradually decreased every time the engine 10 is rotated the predetermined number of times. In the case where the power output P is changed upon the engine rotation of, for instance, r2 or r3 times, i.e., the engine warm-up condition (progress) is changed in response to variation in the load, the power output correction coefficient is increased/decreased in accordance with the change so that the final warm-up correction coefficient decreasing amount is increased/decreased, whereby the warm-up time fuel injection amount suitable for the warm-up condition is calculated and the fuel is injected from the injector 24 by the calculated amount.

Then when the engine 10 is rotated r4 times and the warm-up correction coefficient reaches 1.0, the warm-up control is finished (S20, S22).

As set out in the foregoing, in the third embodiment, the basic fuel injection amount is calculated based on the engine speed NE and the throttle opening TH, and the warm-up time fuel injection amount is calculated by correcting the basic fuel injection amount based on one of the temperature change amount of the spark plug seat 42*a* of the engine 10, the throttle opening and the output of the operating machine, specifically on the output of the operating machine (generator (power coil 56)), and fuel is injected from the injector 24 by the calculated warm-up time fuel injection amount.

More specifically, the warm-up time fuel injection amount is calculated based on, in place of the lubricating oil temperature, the output of the operating machine that influences the warm-up condition. With this, it becomes possible to calculate the fuel injection amount suitable for the engine warm-up condition (progress), thereby enabling to shorten the warm-up operation time and decrease fuel consumption.

Further, the warm-up correction coefficient is calculated based on the output of the operating machine and the warm-up time fuel injection amount is calculated by correcting the basic fuel injection amount with the calculated warm-up correction coefficient after start operation of the engine 10 is completed. With this, the appropriate fuel injection amount can be calculated using the warm-up correction coefficient corresponding to the engine warm-up condition, thereby enabling to further shorten the warm-up operation time and further decrease fuel consumption.

Furthermore, the warm-up correction coefficient is calculated such that it decreases from the warm-up correction coefficient initial value by the final warm-up correction coefficient decreasing amount calculated based on the output of the operating machine. With this, since the warm-up correction coefficient can be decreased gradually (in stages) as the engine 10 is warmed up, it becomes possible to calculate the appropriate fuel injection amount in accordance with the engine warm-up condition.

Furthermore, the engine 10 has the actuator (electric motor 64) adapted to open and close the throttle valve such that the speed NE of the engine is converged to a desired engine speed Nd determined based on the output of the operating machine, i.e., is configured to have the electronic governor. With this, since the throttle opening can be calculated (detected) based on the command value TH used for operating the actuator 64, a throttle opening sensor is not necessary and it becomes possible to calculate the fuel injection amount suitable for the warm-up condition of the engine 10 with the simple structure.

Furthermore, the operating machine comprises the generator (power coil 56) and the output of the operating machine comprises the power output P of the generator. Specifically, the warm-up time fuel injection amount is calculated based on, in place of the lubricating oil temperature, the power output P of the generator that influences the engine warm-up condition. With this, it becomes possible to calculate the fuel injection amount suitable for the warm-up condition (progress) in the engine 10 used as a prime mover of the generator.

The remaining configuration and effects are the same as those in the foregoing embodiments.

A warm-up control apparatus for a general-purpose engine according to a fourth embodiment will be next explained.

Figure 16:
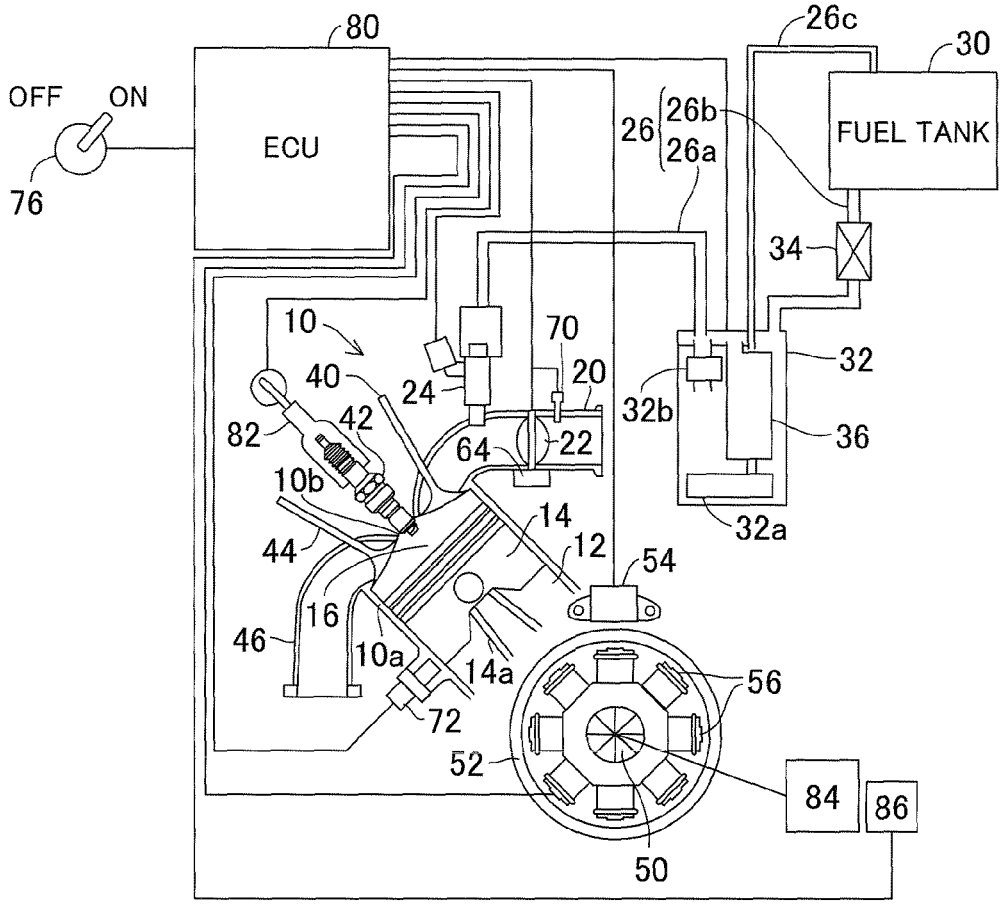
FIG. 16 is an overall view similar to FIG. 1, but schematically showing a warm-up control apparatus for a general-purpose engine according to a fourth embodiment.

FIG. 16 is an overall view similar to FIG. 1, but schematically showing the apparatus according to the fourth embodiment. The explanation will be made with focus on points of difference from the third embodiment. In the fourth embodiment, the engine 10 is used as a prime mover of a pump in place of the generator.

Specifically, as shown in FIG. 16, the other end of the crankshaft 50 is connected to a load 84 comprising a pump (more precisely, a pump for liquid (water pump); operating machine). Although not illustrated, the pump comprising a centrifugal pump discharges water which is sucked into its interior through an intake port, to a supply destination through a discharge port.

A discharge amount sensor (flow rate sensor) 86 is installed near the discharge port as illustrated and produces an output or signal corresponding to a discharge amount Q1 of water discharged from the discharge port. The output of the sensor 86 is sent to the ECU 80. In the fourth embodiment, the output of the power coil 56 is supplied to the battery to charge it and the electric load 61 is removed. Also, constituent elements corresponding to those of the third embodiment are assigned by the same reference symbols and will not be explained.

Figure 17:
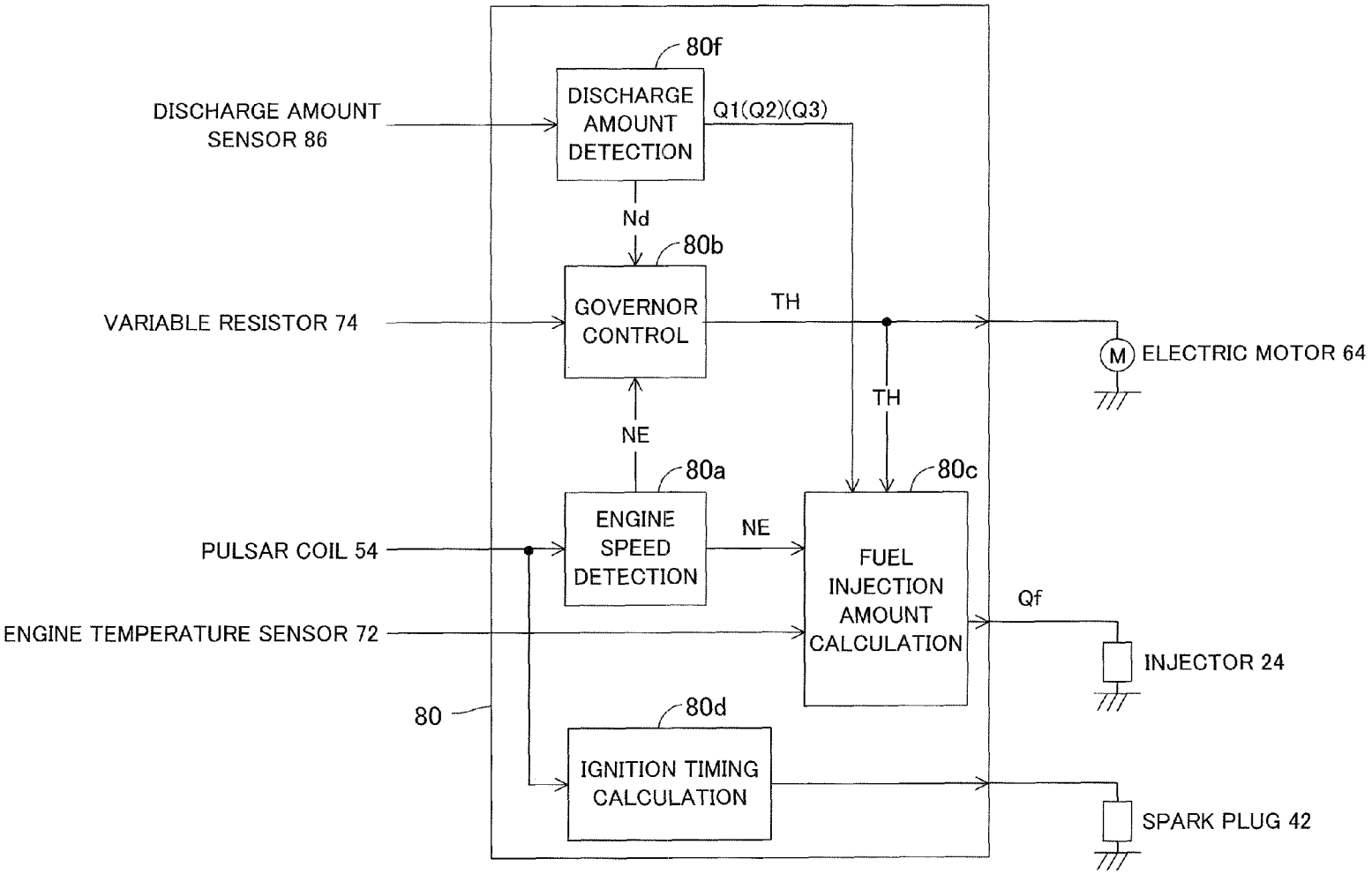
FIG. 17 is a block diagram similar to FIG. 2, but mainly showing the configuration of an Electronic Control Unit (ECU) shown in FIG. 16.

FIG. 17 is a block diagram similar to FIG. 2, but mainly showing the configuration of the ECU 80 in the apparatus according to the fourth embodiment. The ECU 80 comprises a discharge amount detection block 80*f* and the power conversion block 80*e* of the third embodiment is removed.

The discharge amount detection block 80*f* detects the discharge amount of the pump (i.e., an output of the operating machine) Q1 from the output of the discharge amount sensor 86 and sends it to the fuel injection amount calculation block 80*c*. Also based on the detected discharge amount Q1, the block 80*f* determines the desired engine speed Nd, i.e., determines a speed of the engine 10 (desired engine speed) Nd which enables to maintain the operating machine output and sends it to the governor control block 80*b*.

The fuel injection amount calculation block 80*c* calculates the warm-up correction coefficient based on the engine temperature T and the discharge amount Q1 inputted from the discharge amount detection block 80*f*. To be specific, it calculates the warm-up correction coefficient initial value and warm-up correction coefficient decreasing amount based on the engine temperature T and calculates a discharge amount correction coefficient by retrieving a discharge amount correction coefficient map (mapped data; characteristics) set beforehand using the discharge amount Q1. Then it calculates the warm-up correction coefficient based on the initial value, decreasing amount and discharge amount correction coefficient and obtains the warm-up time fuel injection amount by multiplying the basic fuel injection amount by the warm-up correction coefficient.

Figure 18:
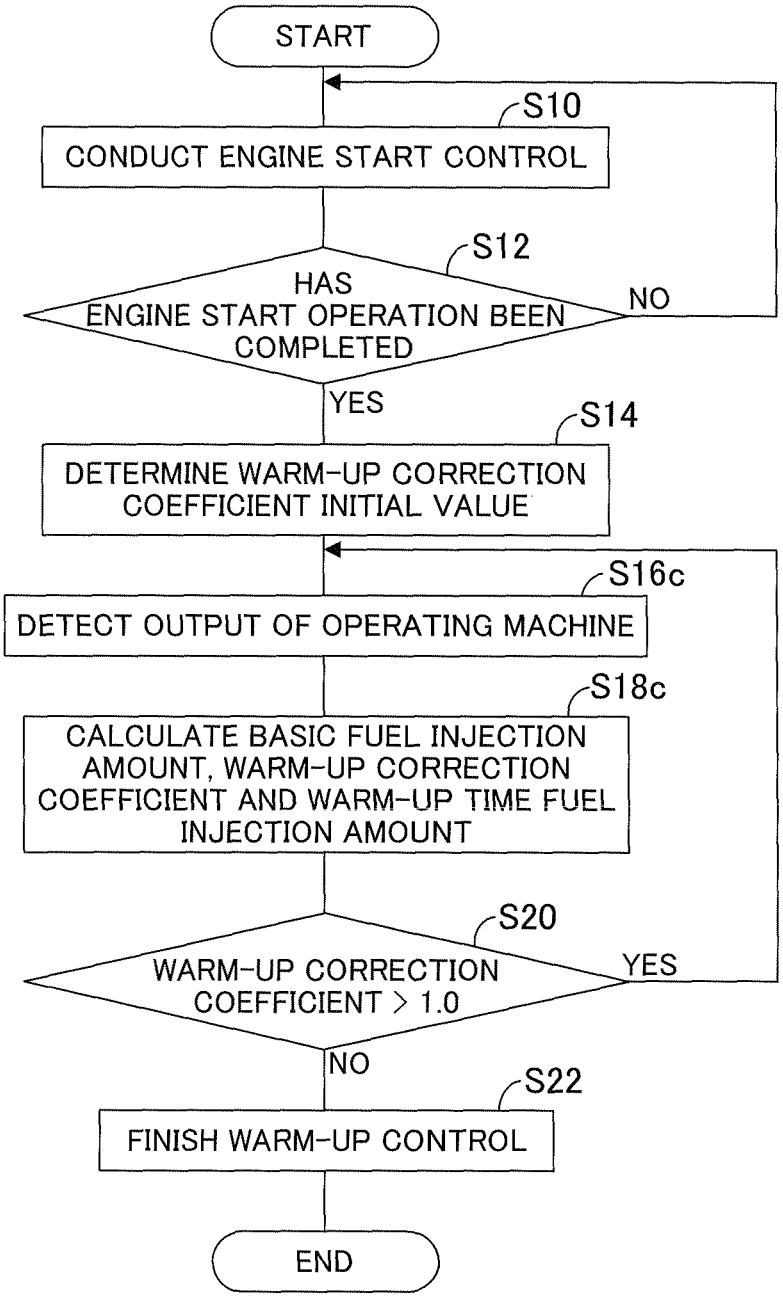
FIG. 18 is a flowchart similar to FIG. 3, but showing fuel injection amount warm-up correction processing of the apparatus shown in FIG. 16.

FIG. 18 is a flowchart similar to FIG. 3, but showing fuel injection amount warm-up correction processing of the apparatus shown in FIG. 16.

After the processing of S10 to S14, the program proceeds to S16*c*, in which the output of the operating machine is detected, i.e., the discharge amount Q1 of the pump is detected and to S18*c*, in which the warm-up correction coefficient is calculated based on the basic fuel injection amount, discharge amount Q1, etc., and the warm-up time fuel injection amount is calculated by correcting the basic fuel injection amount with the calculated warm-up correction coefficient so that the fuel is injected from the injector 24 by the calculated amount.

Specifically, the warm-up time fuel injection amount is calculated through the following Equations.

Warm-up time fuel injection amount=Basic fuel injection amount×Warm-up correction coefficient — Eq. 1

Warm-up correction coefficient=Warm-up correction coefficient initial value−Final warm-up correction coefficient decreasing amount — Eq. 2

Final warm-up correction coefficient decreasing amount=Warm-up correction coefficient decreasing amount×Discharge amount correction coefficient — Eq. 6

Figure 19:
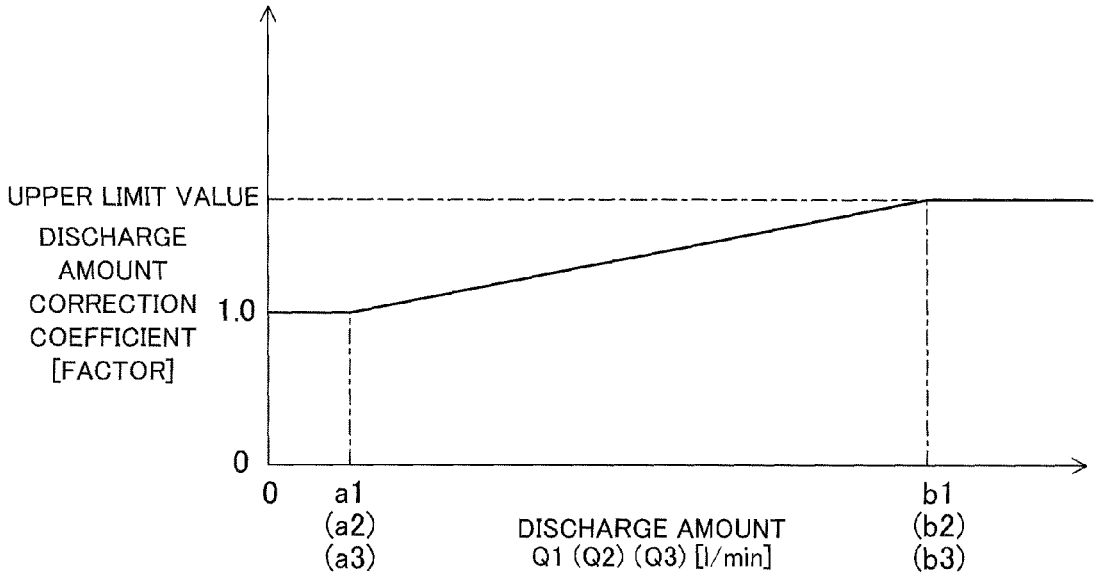
FIG. 19 is a graph showing a map (mapped data) to be used in the processing of the FIG. 18 flowchart.

The Equations 1 and 2 are the same as those in the first embodiment. The final warm-up correction coefficient decreasing amount is calculated by multiplying the warm-up correction coefficient decreasing amount by the discharge amount correction coefficient, as indicated by the Equation 6. The discharge amount correction coefficient is composed of the multiplication term equal to or greater than 1.0 and is calculated by retrieving the discharge amount correction coefficient map shown in FIG. 19 based on the discharge amount Q1 detected in S16*c*.

As illustrated, the discharge amount correction coefficient is 1.0 when the discharge amount Q1 is relatively small (i.e., within a range between 0 and a value a1) and when the discharge amount Q1 is equal to or greater than the value a1 (i.e., when it is relatively large), the coefficient is gradually increased with increasing discharge amount Q1. The coefficient is to be an upper limit value (e.g., 1.75) when the discharge amount Q1 is equal to or greater than a value b1 of greater than the value a1.

As a result, when the discharge amount Q1 is relatively large, the discharge amount correction coefficient is increased, so that the final warm-up correction coefficient decreasing amount obtained through the Equation 6 is increased. Due to the increase in the decreasing amount, the warm-up correction coefficient is decreased through the Equation 2 and consequently, the warm-up time fuel injection amount is decreased through the Equation 1.

The reason why the warm-up time fuel injection amount is decreased when the discharge amount Q1 is relatively large is the same as in the third embodiment. Specifically, when the discharge amount Q1 is relatively large and the load acting on the engine 10 is high, the thermal energy generated through the combustion in the combustion chamber 16 is to be relatively large. In contrast, when the discharge amount Q1 is relatively small and the load is low, the thermal energy is to be relatively small.

Under the above premise, based on the discharge amount Q1, the level of load and the magnitude of thermal energy generated by the combustion can be estimated. Therefore, when the discharge amount Q1 is large so that the load and thermal energy are estimated to be high, since the engine warm-up operation is promoted (goes well) in proportion to the generated thermal energy, the warm-up time fuel injection amount can be decreased from its first-calculated value.

Thus, since the warm-up operation goes well when the discharge amount Q1 is relatively large, in S18*c*, the discharge amount correction coefficient is increased in accordance with the progress of the warm-up operation as mentioned above to increase the final warm-up correction coefficient decreasing amount, so that the warm-up time fuel injection amount calculated by the Equation 1 is decreased.

After that, the processing of S20 and S22 is conducted and the program is terminated.

As set out in the foregoing, in the third embodiment, the basic fuel injection amount is calculated based on the engine speed NE and the throttle opening TH, and the warm-up time fuel injection amount is calculated by correcting the basic fuel injection amount based on one of the temperature change amount of the spark plug seat 42*a* of the engine 10, the throttle opening and the output of the operating machine, specifically on the output of the operating machine (pump (load 84)), and fuel is injected from the injector 24 by the calculated warm-up time fuel injection amount.

More specifically, the warm-up time fuel injection amount is calculated based on, in place of the lubricating oil temperature, the discharge amount Q1 of the pump that influences the engine warm-up condition. With this, it becomes possible to calculate the fuel injection amount suitable for the warm-up condition (progress) in the engine 10 used as a prime mover of the pump.

The remaining configuration and effects are the same as those in the foregoing embodiments.

A warm-up control apparatus for a general-purpose engine according to a fifth embodiment will be next explained.

Figure 20:
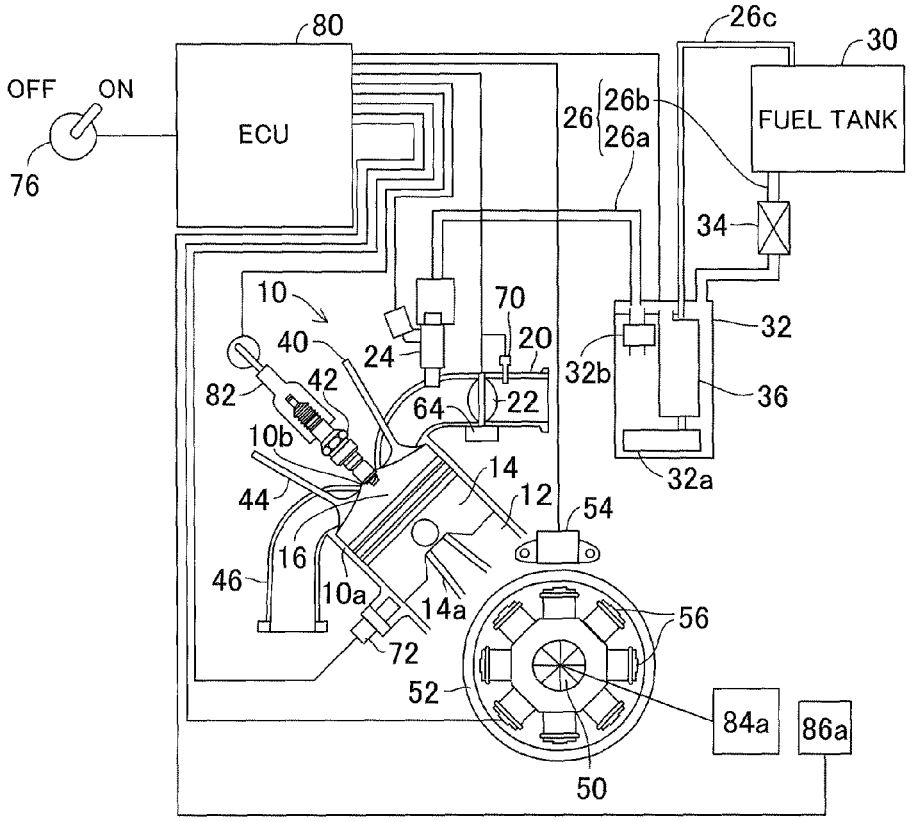
FIG. 20 is an overall view similar to FIG. 1, but schematically showing a warm-up control apparatus for a general-purpose engine according to a fifth embodiment.

FIG. 20 is an overall view similar to FIG. 1, but schematically showing the apparatus according to the fifth embodiment. The explanation will be made with focus on points of difference from the fourth embodiment. In the fifth embodiment, the engine 10 is used as a prime mover of a high-pressure washing machine in place of the pump.

Specifically, as shown in FIG. 20, the other end of the crankshaft 50 is connected to a load 84 comprising a high-pressure washing machine (operating machine). The load is assigned by reference numeral 84 the same as in the fourth embodiment, for ease of understanding and ease of illustration. Also, constituent elements corresponding to those of the fourth embodiment are assigned by the same reference symbols and will not be explained.

Although not illustrated, the high-pressure washing machine has a main body including a pump (pump for liquid (water pump)) driven by the engine 10 and other components, and a washing gun for emitting water pressurized by the pump in response to an emission command inputted by the operator. The pump discharges water which is sucked into its interior through an intake port, to the washing gun through a discharge port. Similarly to the fourth embodiment, the discharge amount sensor (flow rate sensor) 86 is installed near the discharge port and outputs a signal corresponding to a discharge amount Q2 to the ECU 80.

Figure 21:
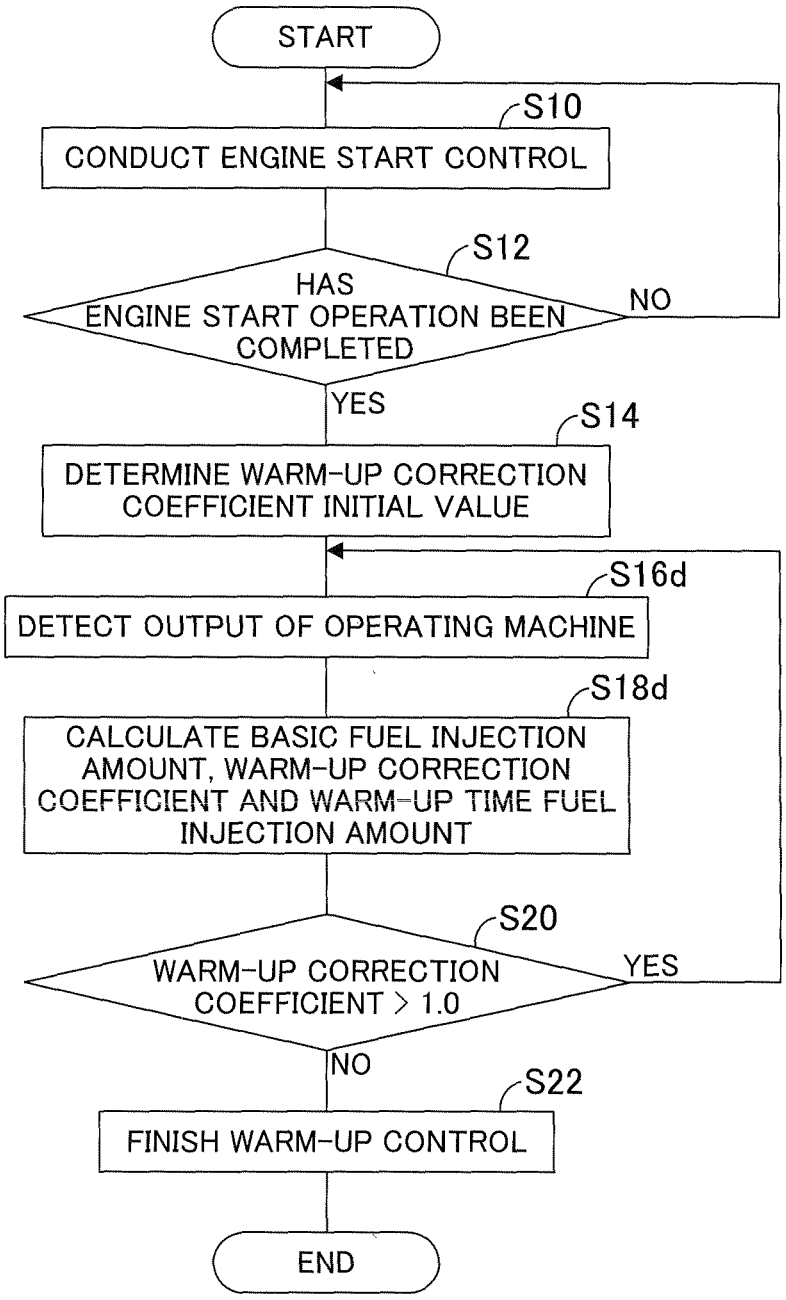
FIG. 21 is a flowchart similar to FIG. 3, but showing fuel injection amount warm-up correction processing of the apparatus shown in FIG. 20.

FIG. 21 is a flowchart similar to FIG. 3, but showing fuel injection amount warm-up correction processing of the apparatus shown in FIG. 20.

In the FIG. 21 flowchart, after the processing of S10 to S14, the program proceeds to S16*d*, in which the output of the operating machine is detected, i.e., the discharge amount Q2 of the pump of the washing machine is detected and to S18*d*, in which the warm-up correction coefficient is calculated based on the basic fuel injection amount, discharge amount Q2, etc., and the warm-up time fuel injection amount is calculated by correcting the basic fuel injection amount with the calculated warm-up correction coefficient so that the fuel is injected from the injector 24 by the calculated amount. The warm-up time fuel injection amount is calculated through the above Equations 1, 2 and 6.

The discharge amount correction coefficient of the Equation 6 is composed of the multiplication term equal to or greater than 1.0 and is calculated by retrieving the discharge amount correction coefficient map shown in FIG. 17 based on the discharge amount Q2 detected in S16*d*. As illustrated, the discharge amount correction coefficient is 1.0 when the discharge amount Q2 is relatively small (i.e., within a range between 0 and a value a2) and when the discharge amount Q2 is equal to or greater than the value a2 (i.e., when it is relatively large), the coefficient is gradually increased with increasing discharge amount Q2. The coefficient is to be an upper limit value (e.g., 1.75) when the discharge amount Q2 is equal to or greater than a value b2 of greater than the value a2.

As a result, when the discharge amount Q2 is relatively large, the discharge amount correction coefficient is increased, so that the final warm-up correction coefficient decreasing amount is increased. Due to the increase in the decreasing amount, the warm-up correction coefficient is decreased and consequently, the warm-up time fuel injection amount is decreased.

The reason why the warm-up time fuel injection amount is decreased when the discharge amount Q2 is relatively large is the same as in the fourth embodiment.

Thus, since the warm-up operation goes well when the discharge amount Q2 is relatively large, in S18*d*, the discharge amount correction coefficient is increased in accordance with the progress of the warm-up operation as mentioned above to increase the final warm-up correction coefficient decreasing amount, so that the warm-up time fuel injection amount calculated by the Equation 1 is decreased.

As set out in the foregoing, in the fifth embodiment, the basic fuel injection amount is calculated based on the engine speed NE and the throttle opening TH, and the warm-up time fuel injection amount is calculated by correcting the basic fuel injection amount based on one of the temperature change amount of the spark plug seat 42*a* of the engine 10, the throttle opening and the output of the operating machine, specifically on the output of the operating machine (high-pressure washing machine (load 84)), and fuel is injected from the injector 24 by the calculated warm-up time fuel injection amount.

More specifically, the warm-up time fuel injection amount is calculated based on, in place of the lubricating oil temperature, the discharge amount Q2 of the high-pressure washing machine that influences the engine warm-up condition. With this, it becomes possible to calculate the fuel injection amount suitable for the warm-up condition (progress) in the engine 10 used as a prime mover of the washing machine.

The remaining configuration and effects are the same as those in the foregoing embodiments.

A warm-up control apparatus for a general-purpose engine according to a sixth embodiment will be next explained.

Figure 22:
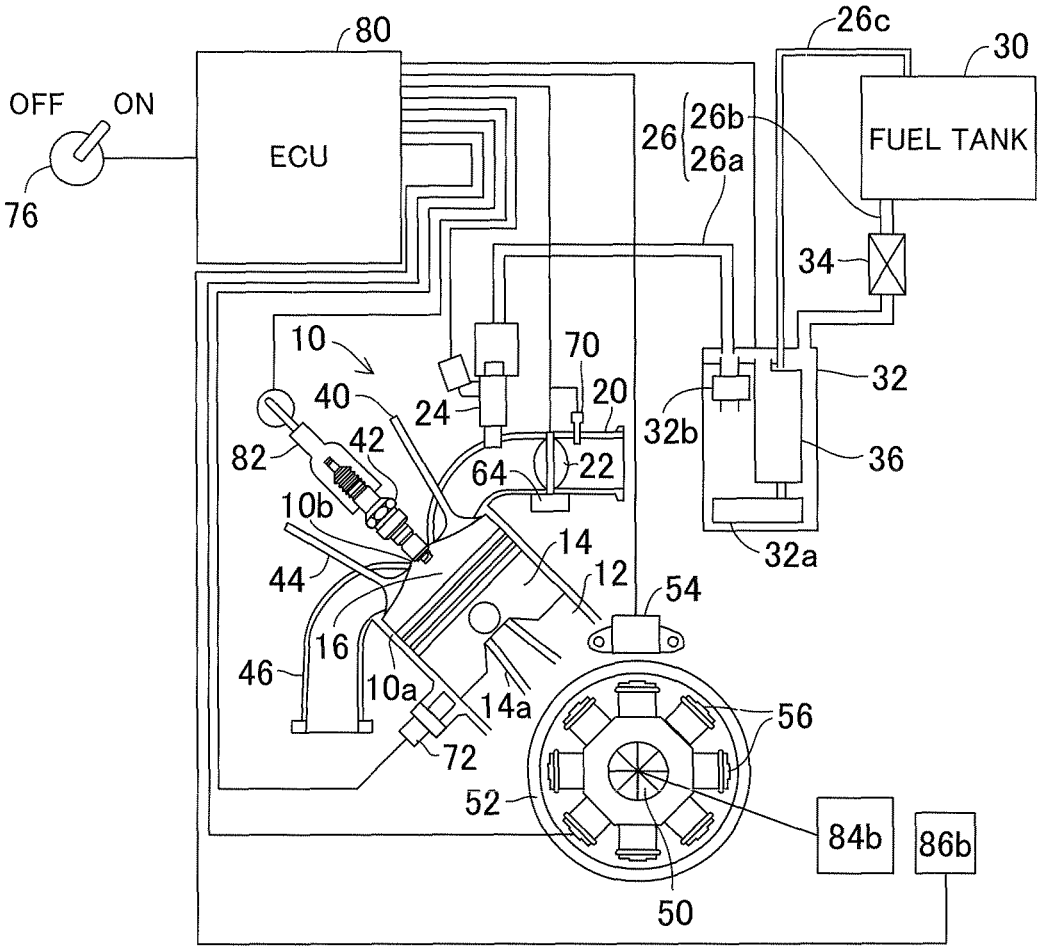
FIG. 22 is an overall view similar to FIG. 1, but schematically showing a warm-up control apparatus for a general-purpose engine according to a sixth embodiment.

FIG. 22 is an overall view similar to FIG. 1, but schematically showing the apparatus according to the sixth embodiment The explanation will be made with focus on points of difference from the fourth embodiment. In the sixth embodiment, the engine 10 is used as a prime mover of a power sprayer in place of the pump.

Specifically, as shown in FIG. 22, the other end of the crankshaft 50 is connected to a load 84 comprising a power sprayer (operating machine). The load is assigned by reference numeral 84 the same as in the fourth embodiment, for ease of understanding and ease of illustration.

Although not illustrated, the power sprayer has a main body including a pump (pump for liquid (water pump) driven by the engine 10 and other components, and a nozzle for spraying liquid (e.g., agrichemicals) pressurized by the pump in the form of mist in response to a spray command inputted by the operator. The pump discharges liquid which is sucked into its interior through an intake port, to the nozzle through a discharge port. Similarly to the fourth embodiment, the discharge amount sensor (flow rate sensor) 86 is installed near the discharge port and outputs a signal corresponding to a discharge amount Q3 to the ECU 80.

Figure 23:
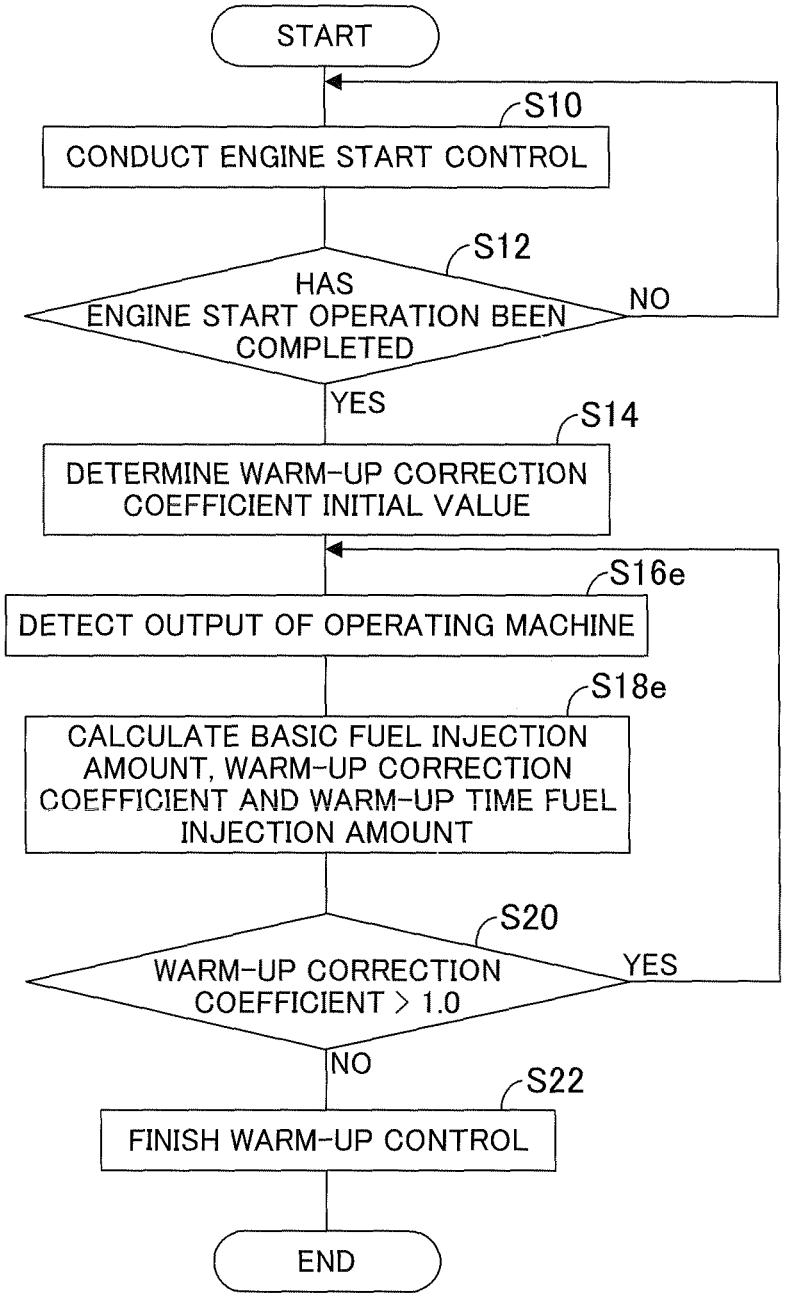
FIG. 23 is a flowchart similar to FIG. 3, but showing fuel injection amount warm-up correction processing of the apparatus shown in FIG. 22.

FIG. 23 is a flowchart similar to FIG. 3, but showing fuel injection amount warm-up correction processing of the apparatus shown in FIG. 22.

In the FIG. 23 flowchart, after the processing of S10 to S14, the program proceeds to S16*e*, in which the output of the operating machine is detected, i.e., the discharge amount Q3 of the pump of the power sprayer is detected and to S18*e*, in which the warm-up correction coefficient is calculated based on the basic fuel injection amount, discharge amount Q3, etc., and the warm-up time fuel injection amount is calculated by correcting the basic fuel injection amount with the calculated warm-up correction coefficient so that the fuel is injected from the injector 24 by the calculated amount. The warm-up time fuel injection amount is calculated through the above Equations 1, 2 and 6.

The discharge amount correction coefficient of the Equation 6 is composed of the multiplication term equal to or greater than 1.0 and is calculated by retrieving the discharge amount correction coefficient map shown in FIG. 17 based on the discharge amount Q3 detected in S16*e*. As illustrated, the discharge amount correction coefficient is 1.0 when the discharge amount Q3 is relatively small (i.e., within a range between 0 and a value a3) and when the discharge amount Q3 is equal to or greater than the value a3 (i.e., when it is relatively large), the coefficient is gradually increased with increasing discharge amount Q3. The coefficient is to be an upper limit value (e.g., 1.75) when the discharge amount Q3 is equal to or greater than a value b3 of greater than the value a3.

As a result, when the discharge amount Q3 is relatively large, the discharge amount correction coefficient is increased, so that the final warm-up correction coefficient decreasing amount is increased and the warm-up correction coefficient is decreased accordingly. Consequently, the warm-up time fuel injection amount is decreased.

The reason why the warm-up time fuel injection amount is decreased when the discharge amount Q3 is relatively large is the same as in the fourth embodiment.

Thus, since the warm-up operation goes well when the discharge amount Q3 is relatively large, in S18*e*, the discharge amount correction coefficient is increased in accordance with the progress of the warm-up operation as mentioned above to increase the final warm-up correction coefficient decreasing amount, so that the warm-up time fuel injection amount calculated by the Equation 1 is decreased.

As set out in the foregoing, in the sixth embodiment, the basic fuel injection amount is calculated based on the engine speed NE and the throttle opening TH, and the warm-up time fuel injection amount is calculated by correcting the basic fuel injection amount based on one of the temperature change amount of the spark plug seat 42*a* of the engine 10, the throttle opening and the output of the operating machine, specifically on the output of the operating machine (power sprayer (load 84)), and fuel is injected from the injector 24 by the calculated warm-up time fuel injection amount.

More specifically, the warm-up time fuel injection amount is calculated based on, in place of the lubricating oil temperature, the discharge amount Q3 of the power sprayer that influences the engine warm-up condition. With this, it becomes possible to calculate the fuel injection amount suitable for the warm-up condition (progress) in the engine 10 used as a prime mover of the power sprayer.

The remaining configuration and effects are the same as those in the foregoing embodiments.

As stated above, the first to sixth embodiments are configured to have an apparatus and method for controlling warm-up operation of a general-purpose internal combustion engine (10) having a throttle valve (22) installed in an air intake pipe (20) and connectable to an operating machine (load 60; load 84 (generator, pump, high-pressure washing machine, power sprayer)) to be used as a prime mover of the machine, comprising: a basic fuel injection amount calculator ((ECU 80, S18, S18*a*, S18*b*, S18*c*, S18*d*, S18*e*) adapted to the apparatus calculating a basic fuel injection amount based on a speed NE of the engine and a throttle opening (command value) TH of the throttle valve; and a warm-up controller (ECU 80, S18, S18*a*, S18*b*, S18*c*, S18*d*, S18*e*) controlling warm-up operation of the engine by calculating a warm-up time fuel injection amount by correcting the calculated basic fuel injection amount based on a temperature change amount of a spark plug seat (42*a*), the throttle opening TH and an output of the operating machine and injecting fuel from an injector (24) by the calculated warm-up time fuel injection amount.

Specifically, the warm-up time fuel injection amount is calculated based on, in place of the lubricating oil temperature, the value that well reflects the increase in the engine temperature through the warm-up operation. With this, it becomes possible to calculate the fuel injection amount suitable for the engine warm-up condition (progress), thereby enabling to shorten the warm-up operation time and decrease fuel consumption.

Further, even when the engine 10 comprises the air-cooled general purpose engine whose warm-up condition (progress) is easily influenced by the ambient temperature, owing to the above configuration, it becomes possible to calculate the appropriate fuel injection amount in accordance with the warm-up condition.

In the apparatus and method in the first embodiment, the warm-up controller calculates a warm-up correction coefficient based on the temperature change amount of the spark plug seat 42*a* and calculates the warm-up time fuel injection amount by correcting the basic fuel injection amount with the calculated warm-up correction coefficient after start operation of the engine (10) is completed (S18). With this, the appropriate fuel injection amount can be calculated using the warm-up correction coefficient corresponding to the engine warm-up condition, thereby enabling to further shorten the warm-up operation time and further decrease fuel consumption.

In the apparatus and method in the first embodiment, the warm-up correction coefficient is calculated such that it decreases from an initial value (warm-up correction coefficient initial value) by a predetermined value (final warm-up correction coefficient decreasing amount) calculated based on the temperature change amount (S18). With this, since the warm-up correction coefficient can be decreased gradually (in stages) as the engine (10) is warmed up, it becomes possible to calculate the appropriate fuel injection amount in accordance with the engine warm-up condition.

In the apparatus and method in the first embodiment, the warm-up correction coefficient is calculated every time the engine (10) is rotated a predetermined number of times or every time a predetermined time period elapses (S18). With this, since the warm-up correction coefficient can be reliably decreased with time, i.e., as the engine 10 is warmed up, it becomes possible to calculate the further appropriate fuel injection amount in accordance with the engine warm-up condition.

In the apparatus and method, the warm-up correction coefficient is composed of a multiplication term equal to or greater than 1.0 and is calculated such that it decreases toward 1.0 by the predetermined value every time the engine is rotated a predetermined number of times or every time a predetermined time period elapses (S18), and the warm-up controller continues the warm-up operation until the warm-up correction coefficient reaches 1.0 (S20, S22). With this, the warm-up correction coefficient can be gradually decreased toward 1.0 as the engine (10) is warmed up and consequently, it becomes possible to calculate the further appropriate fuel injection amount in accordance with the engine warm-up condition. Also, since the warm-up control is continued until the coefficient reaches 1.0, the warm-up operation can be finished at the right time, i.e., when it is completed.

In the apparatus, the engine (10) has an actuator (electric motor) (64) adapted to open and close the throttle valve (22) such that the speed NE of the engine is converged to a desired engine speed Nd set by an operator, i.e., has the electronic governor. With this, since the throttle opening can be calculated (detected) based on the command value TH used for operating the actuator 64, a throttle opening sensor is not necessary and it becomes possible to calculate the fuel injection amount suitable for the warm-up condition of the engine 10 with the simple structure.

In the apparatus and method in the second embodiment, the warm-up controller calculates a warm-up correction coefficient based on the throttle opening TH and calculates the warm-up time fuel injection amount by correcting the basic fuel injection amount with the calculated warm-up correction coefficient after start operation of the engine (10) is completed (S18*a*). With this, the appropriate fuel injection amount can be calculated using the warm-up correction coefficient corresponding to the engine warm-up condition, thereby enabling to further shorten the warm-up operation time and further decrease fuel consumption.

In the apparatus and method, the warm-up correction coefficient is calculated such that it decreases from an initial value (warm-up correction coefficient initial value) by a predetermined value (final warm-up correction coefficient decreasing amount) calculated based on the throttle opening TH (S18*a*). With this, since the warm-up correction coefficient can be decreased gradually (in stages) as the engine 10 is warmed up, it becomes possible to calculate the appropriate fuel injection amount in accordance with the engine warm-up condition.

In the apparatus and method in the second embodiment, the warm-up correction coefficient is calculated every time the engine (10) is rotated a predetermined number of times or every time a predetermined time period elapses (S18*a*). With this, since the warm-up correction coefficient can be reliably decreased with time, i.e., as the engine 10 is warmed up, it becomes possible to calculate the further appropriate fuel injection amount in accordance with the engine warm-up condition.

In the apparatus and method in the second embodiment, the warm-up correction coefficient is composed of a multiplication term equal to or greater than 1.0 and is calculated such that it decreases toward 1.0 by the predetermined value every time the engine is rotated a predetermined number of times or every time a predetermined time period elapses (S18*a*), and the warm-up controller continues the warm-up operation until the warm-up correction coefficient reaches 1.0 (S20, S22). With this, the warm-up correction coefficient can be gradually decreased toward 1.0 as the engine 10 is warmed up and consequently, it becomes possible to calculate the further appropriate fuel injection amount in accordance with the engine warm-up condition. Also, since the warm-up control is continued until the coefficient reaches 1.0, the warm-up operation can be finished at the right time, i.e., when it is completed.

In the apparatus and method in the third to sixth embodiments, the warm-up controller calculates a warm-up correction coefficient based on the output of the operating machine and calculates the warm-up time fuel injection amount by correcting the basic fuel injection amount with the calculated warm-up correction coefficient after start operation of the engine (10) is completed (S18*b*, S18*c*, S18*d*, S18*e*). With this, the appropriate fuel injection amount can be calculated using the warm-up correction coefficient corresponding to the engine warm-up condition, thereby enabling to further shorten the warm-up operation time and further decrease fuel consumption.

In the apparatus and method in the third to sixth embodiments, the warm-up correction coefficient is calculated such that it decreases from an initial value (warm-up correction coefficient initial value) by a predetermined value (final warm-up correction coefficient decreasing amount) calculated based on the output of the operating machine (S18*b*, S18*c*, S18*d*, S18*e*). With this, since the warm-up correction coefficient can be decreased gradually (in stages) as the engine 10 is warmed up, it becomes possible to calculate the appropriate fuel injection amount in accordance with the engine warm-up condition.

In the apparatus and method in the third to sixth embodiments, the warm-up correction coefficient is calculated every time the engine (10) is rotated a predetermined number of times or every time a predetermined time period elapses (S18*b*, S18*c*, S18*d*, S18*e*). With this, since the warm-up correction coefficient can be reliably decreased with time, i.e., as the engine 10 is warmed up, it becomes possible to calculate the further appropriate fuel injection amount in accordance with the engine warm-up condition.

In the apparatus and method in the third to sixth embodiments, the warm-up correction coefficient is composed of a multiplication term equal to or greater than 1.0 and is calculated such that it decreases toward 1.0 by the predetermined value every time the engine is rotated a predetermined number of times or every time a predetermined time period elapses (S18*b*, S18*c*, S18*d*, S18*e*), and the warm-up controller continues the warm-up operation until the warm-up correction coefficient reaches 1.0 (S20, S22). With this, the warm-up correction coefficient can be gradually decreased toward 1.0 as the engine 10 is warmed up and consequently, it becomes possible to calculate the further appropriate fuel injection amount in accordance with the engine warm-up condition. Also, since the warm-up control is continued until the coefficient reaches 1.0, the warm-up operation can be finished at the right time, i.e., when it is completed.

In the apparatus in the first to sixth embodiments, the engine (10) has an actuator (electric motor) (64) adapted to open and close the throttle valve (22) such that the speed NE of the engine is converged to a desired engine speed Nd determined based on the output of the operating machine, i.e., is configured to have the electronic governor. With this, since the throttle opening can be calculated (detected) based on the command value TH used for operating the actuator 64, a throttle opening sensor is not necessary and it becomes possible to calculate the fuel injection amount suitable for the warm-up condition of the engine 10 with the simple structure.

In the apparatus in the third embodiment, the operating machine comprises a generator (power coil) (56) and the output of the operating machine comprises a power output P of the generator. Specifically, the warm-up time fuel injection amount is calculated based on, in place of the lubricating oil temperature, the power output P of the generator that influences the engine warm-up condition. With this, it becomes possible to calculate the fuel injection amount suitable for the warm-up condition (progress) in the engine 10 used as a prime mover of the generator.

In the apparatus in the fourth embodiment, the operating machine comprises a pump (load 84) and the output of the operating machine comprises a discharge amount Q1 of the pump. Specifically, the warm-up time fuel injection amount is calculated based on, in place of the lubricating oil temperature, the discharge amount Q1 of the pump that influences the engine warm-up condition. With this, it becomes possible to calculate the fuel injection amount suitable for the warm-up condition (progress) in the engine 10 used as a prime mover of the pump.

In the apparatus in the fifth embodiment, the operating machine comprises a high-pressure washing machine (load 84) and the output of the operating machine comprises a discharge amount Q2 of the washing machine. Specifically, the warm-up time fuel injection amount is calculated based on, in place of the lubricating oil temperature, the discharge amount Q2 of the high-pressure washing machine that influences the engine warm-up condition. With this, it becomes possible to calculate the fuel injection amount suitable for the warm-up condition (progress) in the engine 10 used as a prime mover of the washing machine.

In the apparatus in the six embodiment, in the apparatus, the operating machine comprises a power sprayer (load 84) and the output of the operating machine comprises a discharge amount Q3 of the power sprayer. Specifically, the warm-up time fuel injection amount is calculated based on, in place of the lubricating oil temperature, the discharge amount Q3 of the power sprayer that influences the engine warm-up condition. With this, it becomes possible to calculate the fuel injection amount suitable for the warm-up condition (progress) in the engine 10 used as a prime mover of the power sprayer.

It should be noted that although the warm-up correction coefficient, warm-up correction coefficient initial value, spark plug seat temperature correction coefficient, throttle opening correction coefficient, power output correction coefficient and discharge amount correction coefficient are composed of multiplication terms, they may be addition terms. Further, although the spark plug seat temperature correction coefficient, throttle opening correction coefficient, power output correction coefficient, discharge amount correction coefficient, warm-up correction coefficient initial value, warm-up correction coefficient decreasing amount, etc., are indicated with specific values in the foregoing, they are only examples and not limited thereto.

It should also be noted that, in the first embodiment, although the warm-up time fuel injection amount is calculated based on the temperature change amount of the spark plug seat 42*a*, a change amount of, for instance, the engine temperature or exhaust gas temperature can be utilized instead.

Japanese Patent Application Nos. 2010-201471, 2010-201473 and 2010-201474, all filed on Sep. 8, 2010, are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling warm-up operation of a general-purpose internal combustion engine, the internal combustion engine being an air-cooled engine and connectable to an operating machine to be used as a prime mover of the operating machine, the apparatus comprising:

a basic fuel injection amount calculator adapted to calculate a basic fuel injection amount based on a speed of the air-cooled engine and a throttle opening of a throttle valve; and a warm-up controller adapted to control warm-up operation of the air-cooled engine by calculating a warm-up time fuel injection amount by correcting the calculated basic fuel injection amount based on a warm-up correction coefficient calculated based on a temperature of a cylinder head of the air-cooled engine and one of a temperature change amount of a spark plug seat of the air-cooled engine, the throttle opening and an output of the operating machine, and injecting fuel from an injector by the calculated warm-up time fuel injection amount, wherein the warm-up controller calculates a first coefficient based on the one of the temperature change amount of the spark plug seat, the throttle opening and the output of the operating machine, calculates a second coefficient based on the temperature of the cylinder head, calculates the warm-up correction coefficient by subtracting a value determined by multiplying the first coefficient by the second coefficient from an initial value calculated based on the temperature of the cylinder head, and the warm-up correction coefficient becomes smaller as the first coefficient increases along with an increase of a load acting on the air-cooled engine.

2. The apparatus according to claim 1, wherein the warm-up controller calculates the warm-up time fuel injection amount by correcting the basic fuel injection amount with the calculated warm-up correction coefficient after start operation of the air-cooled engine is completed.

3. The apparatus according to claim 1, wherein the warm-up correction coefficient is calculated every time the air-cooled engine is rotated a predetermined number of times or every time a predetermined time period elapses.

4. The apparatus according to claim 1, wherein the warm-up correction coefficient is composed of a multiplication term equal to or greater than 1.0 and is calculated such that it decreases toward 1.0 by a predetermined value every time the air-cooled engine is rotated a predetermined number of times or every time a predetermined time period elapses, and the warm-up controller continues the warm-up operation until the warm-up correction coefficient reaches 1.0.

5. The apparatus according to claim 1, wherein the air-cooled engine has an actuator adapted to open and close the throttle valve such that the speed of the air-cooled engine is converged to a desired engine speed set by an operator.

6. The apparatus according to claim 1, wherein the air-cooled engine has an actuator adapted to open and close the throttle valve such that the speed of the air-cooled engine is converged to a desired engine speed determined based on the output of the operating machine.

7. The apparatus according to claim 1, wherein the operating machine comprises a generator, and the output of the operating machine comprises a power output of the generator.

8. The apparatus according to claim 1, wherein the operating machine comprises a pump, and the output of the operating machine comprises a discharge amount of the pump.

9. The apparatus according to claim 1, wherein the operating machine comprises a high-pressure washing machine, and the output of the operating machine comprises a discharge amount of the washing machine.

10. The apparatus according to claim 1, wherein the operating machine comprises a power sprayer, and the output of the operating machine comprises a discharge amount of the power sprayer.

11. The apparatus according to claim 1, wherein the initial value decreases along with an increase of the temperature of the cylinder head.

12. The apparatus according to claim 1, wherein the second coefficient increases along with an increase of the temperature of the cylinder head when the temperature of the cylinder head is smaller than a predetermined temperature.

13. The apparatus according to claim 12, wherein the second coefficient is 0 when the temperature of the cylinder head is equal to or greater than the predetermined temperature.

14. The apparatus according to claim 1, wherein the first coefficient increases along with an increase of the temperature change amount of the spark plug seat, an increase of the throttle opening, or an increase of the output of the operating machine.

15. The apparatus according to claim 1, wherein when the first coefficient is calculated based on the temperature change amount of the spark plug seat, the first coefficient is 1.0 when the temperature change amount of the spark plug seat is smaller than a first predetermined value, increases along with an increase of the temperature change amount of the spark plug seat when the temperature change amount of the spark plug seat is equal to or greater than the first predetermined value and smaller than a second predetermined value, and is a predetermined upper limit when the temperature change amount of the spark plug seat is equal to or greater than the second predetermined value.

16. The apparatus according to claim 1, wherein when the first coefficient is calculated based on the throttle opening, the first coefficient is 1.0 when the throttle opening is smaller than a first predetermined value, increases along with an increase of the throttle opening when the throttle opening is equal to or greater than the first predetermined value and smaller than a second predetermined value, and is a predetermined upper limit when the throttle opening is equal to or greater than the second predetermined value.

17. The apparatus according to claim 1, wherein when the first coefficient is calculated based on the output of the operating machine, the first coefficient is 1.0 when the output of the operating machine is smaller than a first predetermined value, increases along with an increase of the output of the operating machine when the output of the operating machine is equal to or greater than the first predetermined value and smaller than a second predetermined value, and is a predetermined upper limit when the output of the operating machine is equal to or greater than the second predetermined value.

18. A method for controlling warm-up operation of a general-purpose internal combustion engine, the internal combustion engine being an air-cooled engine and connectable to an operating machine to be used as a prime mover of the operating machine, the method comprising the steps of:

calculating a basic fuel injection amount based on a speed of the air-cooled engine and a throttle opening of a throttle valve; and controlling warm-up operation of the air-cooled engine by calculating a warm-up time fuel injection amount by correcting the calculated basic fuel injection amount based on a warm-up correction coefficient calculated based on a temperature of a cylinder head of the air-cooled engine and one of a temperature change amount of a spark plug seat of the air-cooled engine, the throttle opening and an output of the operating machine, and injecting fuel from an injector by the calculated warm-up time fuel injection amount, wherein the step of controlling warm-up operation of the air-cooled engine comprises:

calculating a first coefficient based on the one of the temperature change amount of the spark plug seat, the throttle opening and the output of the operating machine;

calculating the second coefficient based on the temperature of the cylinder head;

calculating the warm-up correction coefficient by subtracting a value determined by multiplying the first coefficient by the second coefficient from an initial value calculated based on the temperature of the cylinder head, and the warm-up correction coefficient becomes smaller as the first coefficient increases along with an increase of a load acting on the air-cooled engine.

19. The method according to claim 18, wherein the step of controlling warm-up operation of the air-cooled engine calculates the warm-up time fuel injection amount by correcting the basic fuel injection amount with the calculated warm-up correction coefficient after start operation of the air-cooled engine is completed.

20. The method according to claim 18, wherein the warm-up correction coefficient is calculated every time the air-cooled engine is rotated a predetermined number of times or every time a predetermined time period elapses.

21. The method according to claim 18, wherein the warm-up correction coefficient is composed of a multiplication term equal to or greater than 1.0 and is calculated such that it decreases toward 1.0 by a predetermined value every time the air-cooled engine is rotated a predetermined number of times or every time a predetermined time period elapses, and the step of controlling continues the warm-up operation until the warm-up correction coefficient reaches 1.0.

22. The method according to claim 18, wherein the initial value decreases along with an increase of the temperature of the cylinder head.

23. The method according to claim 18, wherein the second coefficient increases along with an increase of the temperature of the cylinder head when the temperature of the cylinder head is smaller than a predetermined temperature.

24. The method according to claim 23, wherein the second coefficient is 0 when the temperature of the cylinder head is equal to or greater than the predetermined temperature.

25. The method according to claim 18, wherein the first coefficient increases along with an increase of the temperature change amount of the spark plug seat, an increase of the throttle opening, or an increase of the output of the operating machine.

26. The method according to claim 18, wherein when the first coefficient is calculated based on the temperature change amount of the spark plug seat, the first coefficient is 1.0 when the temperature change amount of the spark plug seat is smaller than a first predetermined value, increases along with an increase of the temperature change amount of the spark plug seat when the temperature change amount of the spark plug seat is equal to or greater than the first predetermined value and smaller than a second predetermined value, and is a predetermined upper limit when the temperature change amount of the spark plug seat is equal to or greater than the second predetermined value.

27. The method according to claim 18, wherein when the first coefficient is calculated based on the throttle opening, the first coefficient is 1.0 when the throttle opening is smaller than a first predetermined value, increases along with an increase of the throttle opening when the throttle opening is equal to or greater than the first predetermined value and smaller than a second predetermined value, and is a predetermined upper limit when the throttle opening is equal to or greater than the second predetermined value.

28. The method according to claim 18, wherein when the first coefficient is calculated based on the output of the operating machine, the first coefficient is 1.0 when the output of the operating machine is smaller than a first predetermined value, increases along with an increase of the output of the operating machine when the output of the operating machine is equal to or greater than the first predetermined value and smaller than a second predetermined value, and is a predetermined upper limit when the output of the operating machine is equal to or greater than the second predetermined value.

* * * * *